US009926042B2

(12) United States Patent
Khachaturian

(10) Patent No.: US 9,926,042 B2
(45) **Date of Patent: *Mar. 27, 2018**

(54) MARINE LIFTING APPARATUS

(71) Applicant: Jon Khachaturian, New Orleans, LA (US)

(72) Inventor: Jon Khachaturian, New Orleans, LA (US)

(73) Assignee: VERSABAR, INC., Belle Chasse, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/469,067

(22) Filed: Mar. 24, 2017

(65) Prior Publication Data

US 2017/0291662 A1 Oct. 12, 2017

Related U.S. Application Data

(63) Continuation of application No. 14/667,028, filed on Mar. 24, 2015, now Pat. No. 9,604,710, which is a (Continued)

(51) Int. Cl.

| | |
|---|---|
| ***B63B 1/10*** | (2006.01) |
| ***B63C 3/06*** | (2006.01) |
| ***B63C 7/04*** | (2006.01) |
| ***B63C 7/16*** | (2006.01) |
| ***B63B 1/12*** | (2006.01) |
| *B63B 27/10* | (2006.01) |

(52) U.S. Cl.

CPC ..... *B63B 1/121* (2013.01); *B63C 3/06* (2013.01); *B63C 7/04* (2013.01); *B63C 7/16* (2013.01); *B63B 27/10* (2013.01); *B63B 2001/123* (2013.01)

(58) Field of Classification Search

CPC ..... B63B 1/14; B63B 1/121; B63B 2001/123; B63B 27/10; B63B 27/16; B63B 2027/165; B63B 27/36; B63B 2738/00; B63B 2738/12; B63C 3/06; B63C 7/00; B63C 7/02; B63C 7/04; B63C 7/16; B63C 2205/08; B63C 2702/02

See application file for complete search history.

(56) References Cited

U.S. PATENT DOCUMENTS 485,398 A * 11/1892 Tyler ..... B63C 7/04 114/51
9,604,710 B2 * 3/2017 Khachaturian ..... B63C 7/04

* cited by examiner

*Primary Examiner* — Ajay Vasudeva
(74) *Attorney, Agent, or Firm* — Garvey, Smith & Nehrbass, Patent Attorneys, L.L.C.; Charles C. Garvey, Jr.; Vanessa M. D'Souza

(57) ABSTRACT

A catamaran lifting apparatus is disclosed for lifting objects in a marine environment. The apparatus includes first and second vessels that are spaced apart during use. A first frame spans between the vessels. A second frame spans between the vessels. The frames are spaced apart and connected to the vessels in a configuration that spaces the vessels apart. The first frame connects to the first vessel with a universal joint and to the second vessel with a hinged connection. The second frame connects to the second vessel with a universal joint and to the first vessel with a hinged or pinned connection. Each of the frames extends upwardly in an inverted u-shape, providing a space under the frame and in between the barges that enables a marine vessel to be positioned in between the barges and under the frames.

24 Claims, 21 Drawing Sheets

Related U.S. Application Data continuation of application No. 13/260,501, filed as application No. PCT/US2010/027309 on Mar. 15, 2010, now Pat. No. 8,985,040, which is a continuation of application No. 12/411,948, filed on Mar. 26, 2009, now abandoned, which is a continuation-in-part of application No. 11/610,271, filed on Dec. 13, 2006, now Pat. No. 7,527,006.

(60) Provisional application No. 60/743,917, filed on Mar. 29, 2006.

MARINE LIFTING APPARATUS

CROSS-REFERENCE TO RELATED APPLICATIONS

Incorporated herein by reference is U.S. patent application Ser. No. 12/411,948, filed 26 Mar. 2009, which is a continuation-in-part of U.S. patent application Ser. No. 11/610,271, filed 13 Dec. 2006, now U.S. Pat. No. 7,527,006, both of which are also incorporated herein by reference.

Priority of US patent application Ser. No. 12/411,948, filed 26 Mar. 2009, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to marine lifting devices. More particularly, the present invention relates to an improved catamaran type lifting apparatus that employs spaced apart or catamaran hulls, each of the hulls supporting a truss or frame that spans between the hulls at spaced apart positions. Even more particularly, the present invention relates to an improved catamaran lifting apparatus for use in a marine environment, wherein spaced apart frames are connected to the hulls in a configuration that spaces the vessels apart, the first frame connecting with a first of the hulls with the universal joint and to the second hull with a hinged connection, the second frame connecting to the second hull with a universal joint and to the first hull with a hinged connection.

2. General Background

A catamaran lifting apparatus that can be used to lift multi-ton objects employs two spaced apart barges or hulls or vessels. In general, such lifting devices that employ a pair of spaced apart hulls have been patented, many patents having been issued to applicant as contained in the following table.

TABLE 1

| PAT. NO. | TITLE | ISSUE DATE |
|---|---|---|
| 4,714,382 | Method and Apparatus for the Offshore Installation of Multi-Ton Prefabricated Deck Packages on Partially Submerged Offshore Jacket Foundations | Dec. 22, 1987 |
| 5,607,260 | Method and Apparatus for the Offshore Installation of Multi-Ton Prefabricated Deck Packages on Partially Submerged Offshore Jacket Foundations | Mar. 1, 1997 |
| 5,609,441 | Method and Apparatus for the Offshore Installation of Multi-Ton Prefabricated Deck Packages on Partially Submerged Offshore Jacket Foundations | Mar. 11, 1997 |
| 5,662,434 | Method and Apparatus for the Offshore Installation of Multi-Ton Prefabricated Deck Packages on Partially Submerged Offshore Jacket Foundations | Sep. 2, 1997 |

TABLE 1-continued

| PAT. NO. | TITLE | ISSUE DATE |
|---|---|---|
| 5,800,093 | Method and Apparatus for the Offshore Installation of Multi-Ton Packages Such as Deck Packages, Jackets, and Sunken Vessels | Sep. 1, 1998 |
| 5,975,807 | Method and Apparatus for the Offshore Installation of Multi-Ton Packages Such as Deck Packages and Jackets | Nov. 2, 1999 |
| 6,039,506 | Method and Apparatus for the Offshore Installation of Multi-Ton Packages Such as Deck Packages and Jackets | Mar. 21, 2000 |
| 6,149,350 | Method and Apparatus for the Offshore Installation of Multi-Ton Packages Such as Deck Packages and Jackets | Nov. 21, 2000 |
| 6,318,931 | Method and Apparatus for the Offshore Installation of Multi-Ton Packages Such as Deck Packages and Jackets | Nov. 20, 2001 |
| 6,364,574 | Method and Apparatus for the Offshore Installation of Multi-Ton Packages Such as Deck Packages and Jackets | Apr. 2, 2002 |

BRIEF SUMMARY OF THE INVENTION

The present invention provides an improved catamaran lifting apparatus that employs first and second spaced apart vessels or hulls. The vessels can be barges, dynamically positioned marine vessels, other floating hulls or the like.

A first frame or truss spans between the vessels or hulls at a first position. A second frame or truss spans between the hulls at a second position. The first and second positions are spaced apart so that each frame can move independently of the other, notwithstanding wave action acting upon the hulls. Load spreaders can provide an interface between each frame or truss and each vessel (e.g. barge, ship, etc.)

The first of the frames or trusses connects to the first hull or vessel with a universal joint and to the second hull or vessel with a hinged connection. The second frame connects to the second hull with a universal joint and to the first hull with a hinged connection.

The catamaran hull arrangement of the present invention provides longitudinal flexibility in a quartering sea state due to the unique universal joint and hinge placement between the frames or trusses and the hulls or vessels.

Each frame extends upwardly in a generally inverted u-shape that provides space under each frame or truss and in between the vessels or hulls for enabling a marine vessel to be positioned in between the hulls and under the frames. The space in between the hulls or vessels and under the frames or trusses can also be used as clearance for elevating an object to be salvaged from the seabed to a position next to or above the water's surface.

In a plan view, each frame or truss can be generally triangular in shape. Winches and rigging such as a block and tackle arrangement can be used to lift objects with the apparatus of the present invention. The frames can each be of a truss configuration.

In a second embodiment, one or more slings can be provided that connect between a frame and a hull. The connection of each frame to a hull opposite the universal joint can be a pinned or a hinged connection.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein:

FIGS. 9A-9D are fragmentary views of the preferred embodiment of the apparatus of the present invention, wherein FIG. 9B is a sectional, top view taken along lines 9B-9B of FIG. 9A, FIG. 9C is an elevation view taken along lines 9C-9C of FIG. 9A, and FIG. 9D is a sectional view taken along lines 9D-9D of FIG. 9C;

DETAILED DESCRIPTION OF THE INVENTION

Figure 1:
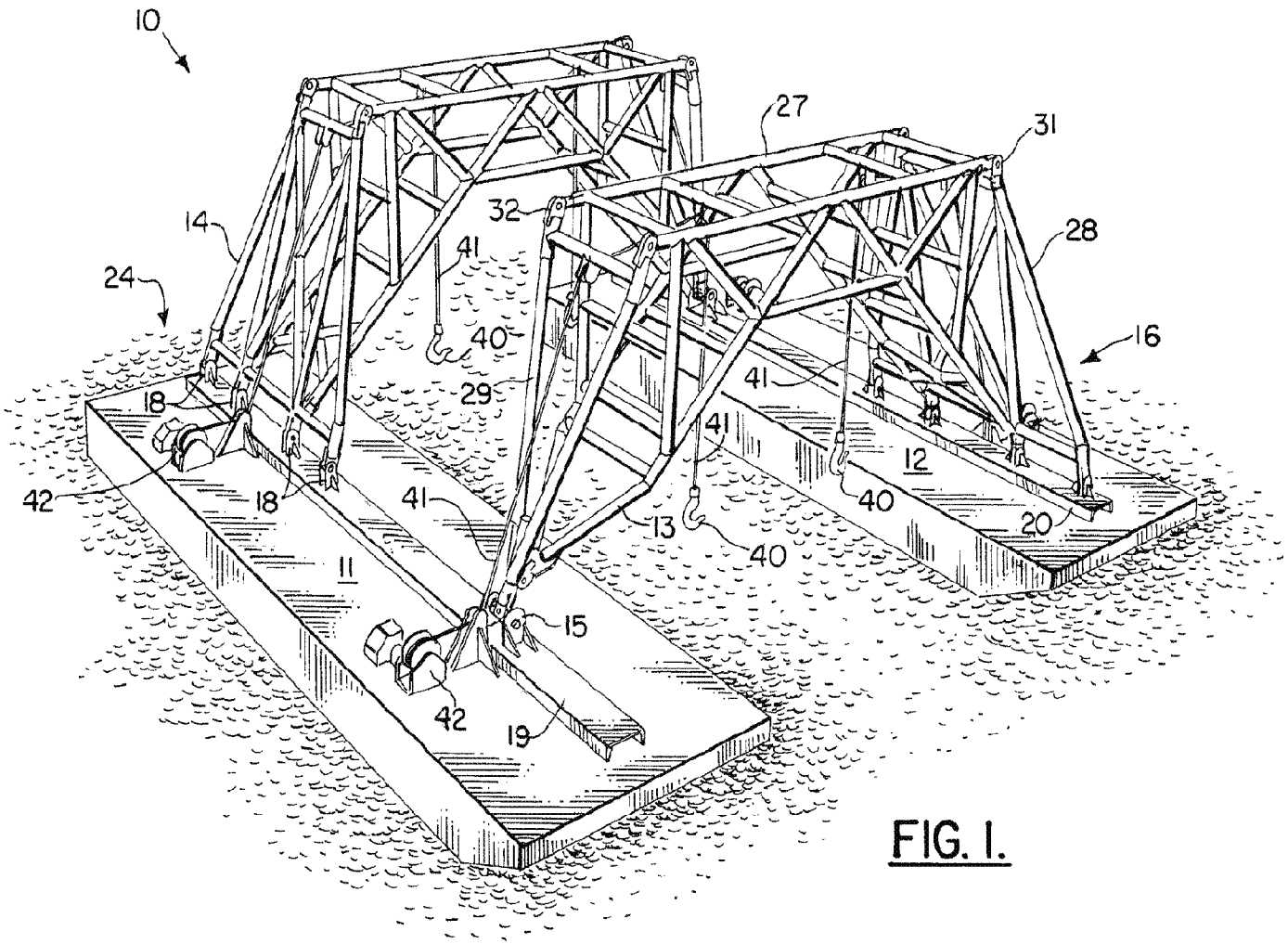
FIG. 1 is a perspective view of the preferred embodiment of the apparatus of the present invention.
Figure 2:
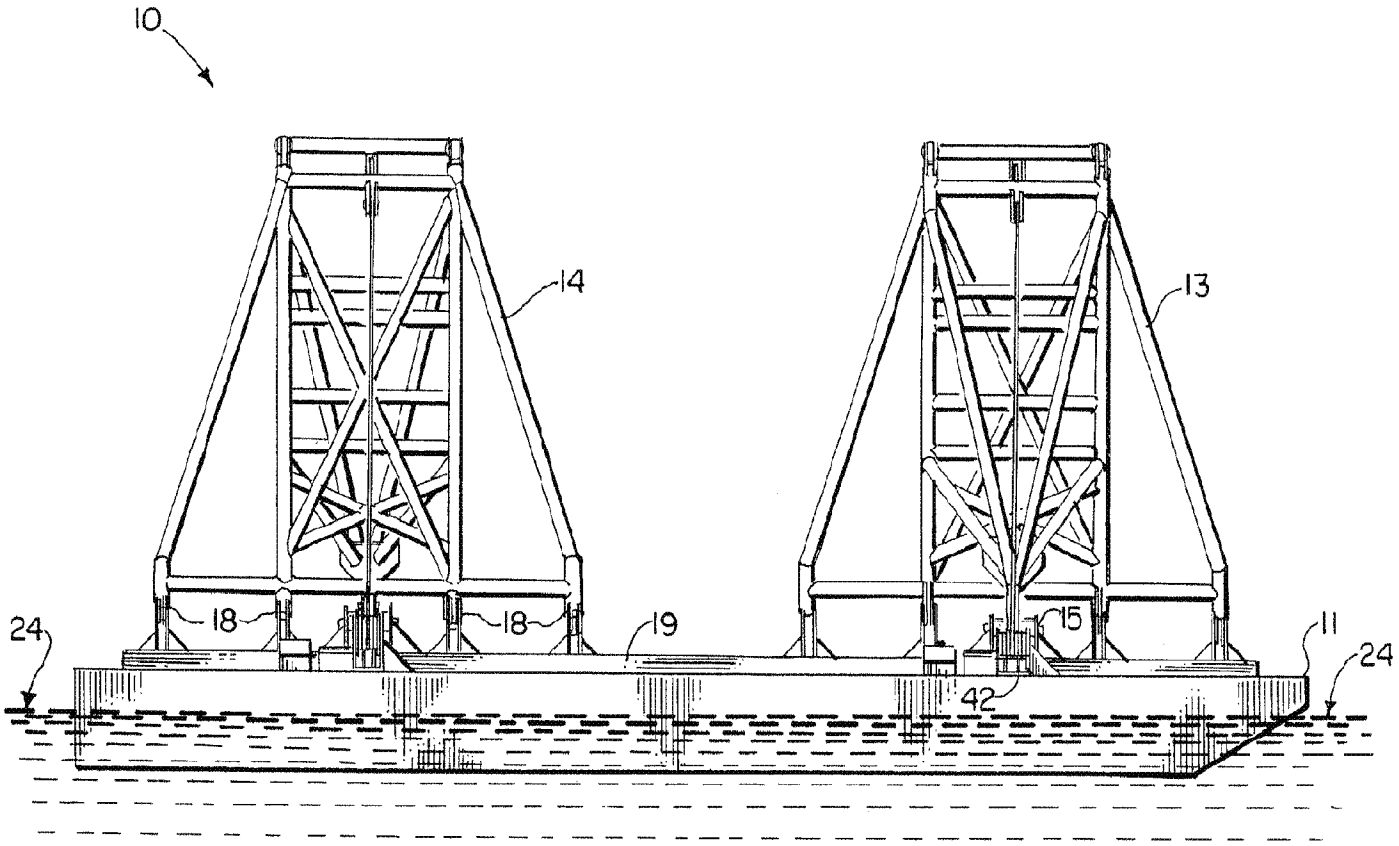
FIG. 2 is a side, elevation view of the preferred embodiment of the apparatus of the present invention.

FIGS. 1-7 and 9-11 show the preferred embodiment of the apparatus of the present invention designated generally by the numeral 10. Marine lifting apparatus 10 provides a pair of spaced apart vessels or hulls 11, 12, each providing a deck 30. Hulls 11, 12 can be barges, dynamically positioned vessels, or any other buoyant structure. A pair of frames or trusses 13, 14 are provided, each frame 13, 14 spanning between the vessels 11, 12. Each frame 13, 14 connects to one vessel 11 or 12 with a universal joint 15 or 17 (see FIGS. 1, 4, 9) and to the other hull 11 or 12 with a hinged or pinned connection 16 or 18 (see FIGS. 4-12).

The first frame 13 connects to hull 11 with universal joint 15 (or articulating connection). The first frame 13 connects to vessel 12 with a pinned connection or hinge 16. Similarly, the second frame 14 connects to hull 12 with a universal joint 17 (or articulating connection) and to hull 11 with a hinge or pinned connection 18 (see FIG. 4).

An interface such as a deck beam or load spreader platform 19 or 20 can be provided on the upper deck 30 of each hull 11, 12 for forming an interface between the frames 13, 14 and the vessels 11, 12. For example, vessel 11 is provided with deck beam or load spreader platform 19 on its deck 30 that forms an interface between each of the frames 13, 14 and the barge or vessel 11 deck 30. Deck beam or load spreader platform 20 provides an interface between each of the frames 13, 14 and deck 30 of the vessel or barge 12.

Figure 4:
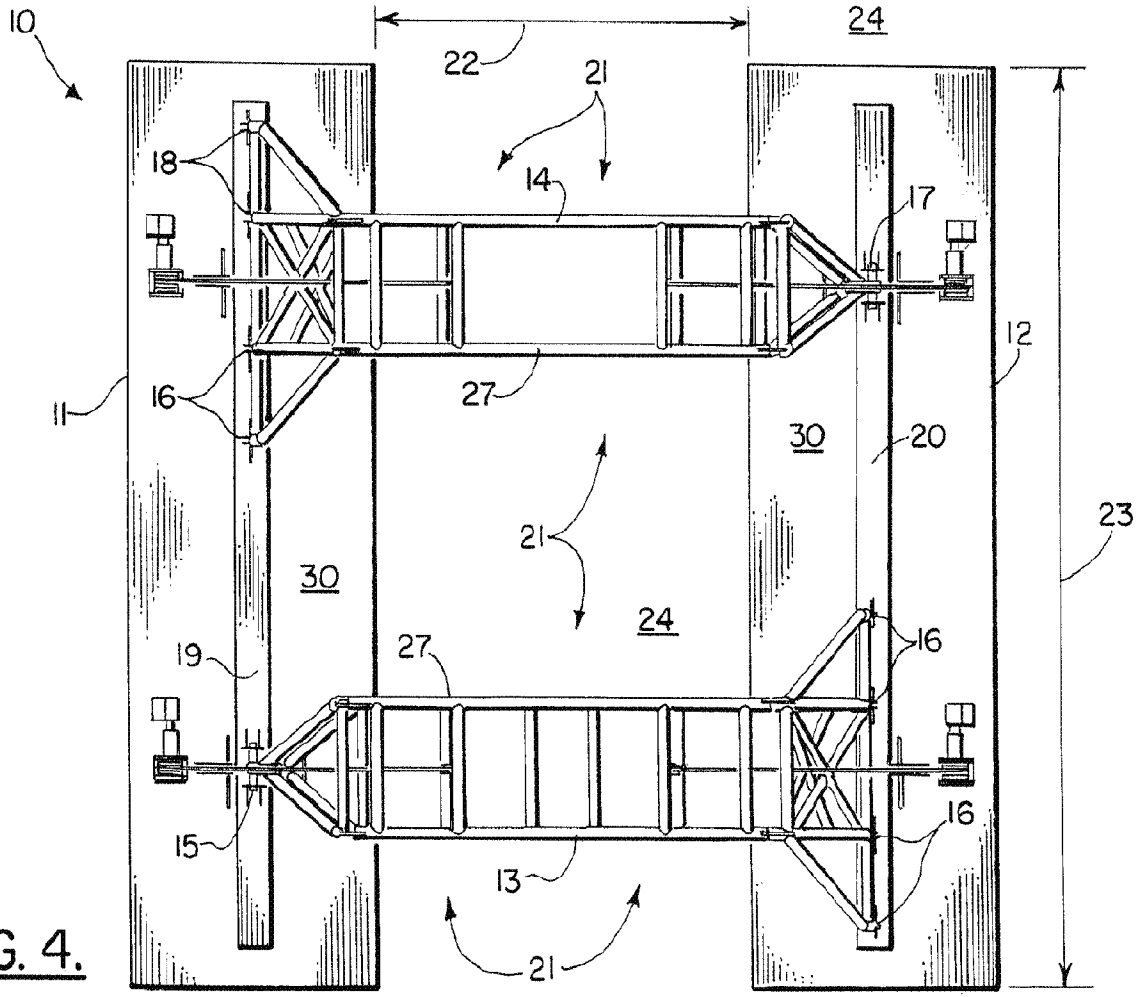
FIG. 4 is a top plan view of the preferred embodiment of the apparatus of the present invention.
Figure 5:
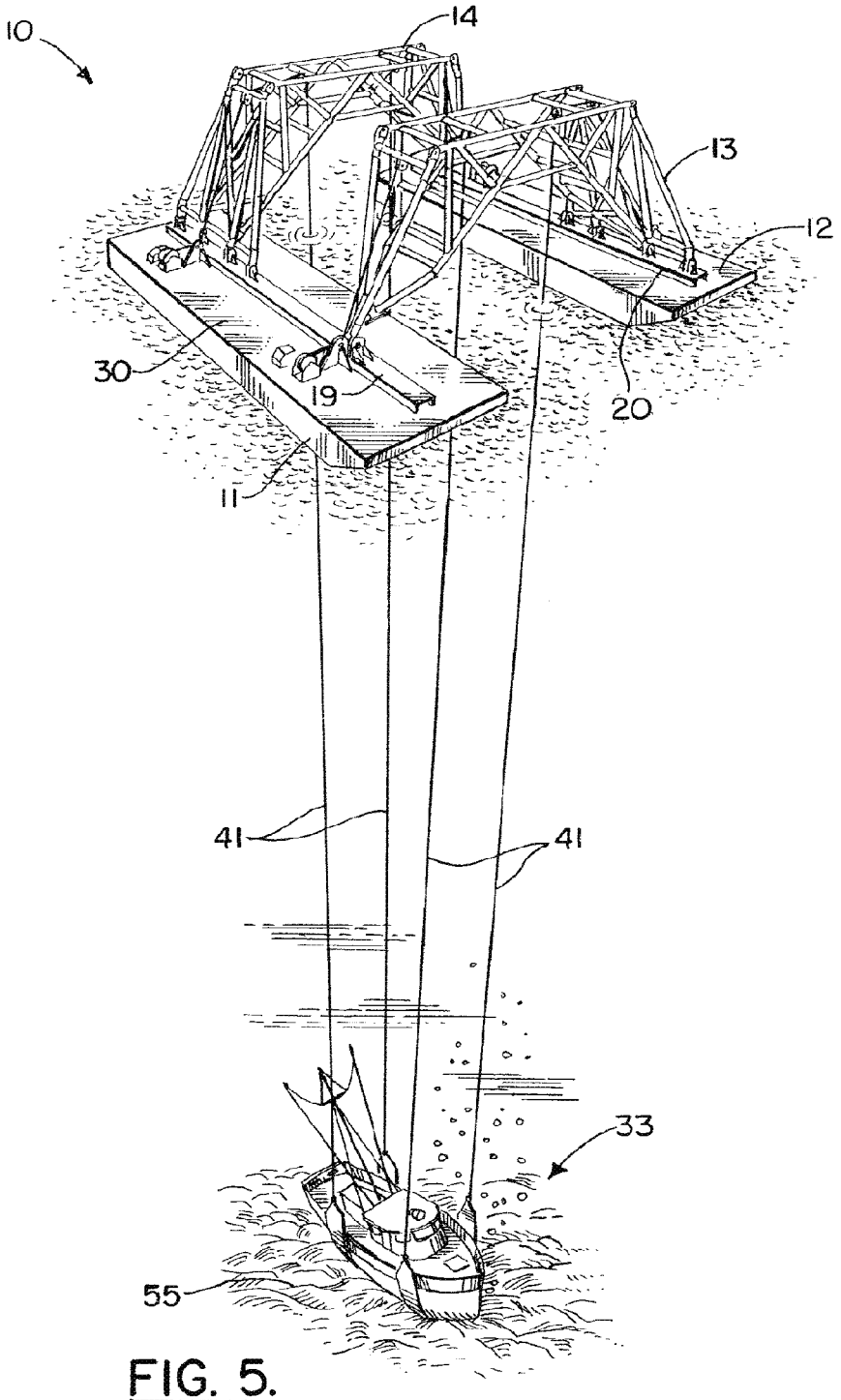
FIG. 5 is a perspective view of the preferred embodiment of the apparatus of the present invention.

In FIG. 4, a plan or top view of the apparatus 10 of the present invention is shown. A lifting area 21 is that area that is in between the vessels 11, 12, the area 21 having a length defined by dimension arrow 23 and a width defined by dimension arrow 22 in FIG. 4. This area 21 is sized and shaped to receive a vessel having a cargo to be lifted if that cargo (e.g. deck package) is to be installed. Alternatively, the area 21 can be an area that receives a vessel for supporting and transporting an item to be salvaged from an ocean floor (see FIGS. 5 and 11-15) such as a hurricane smashed or damaged offshore platform section 34, sunken boat 33 or the like. In either case, a clearance is provided above the water surface 24.

Figure 3:
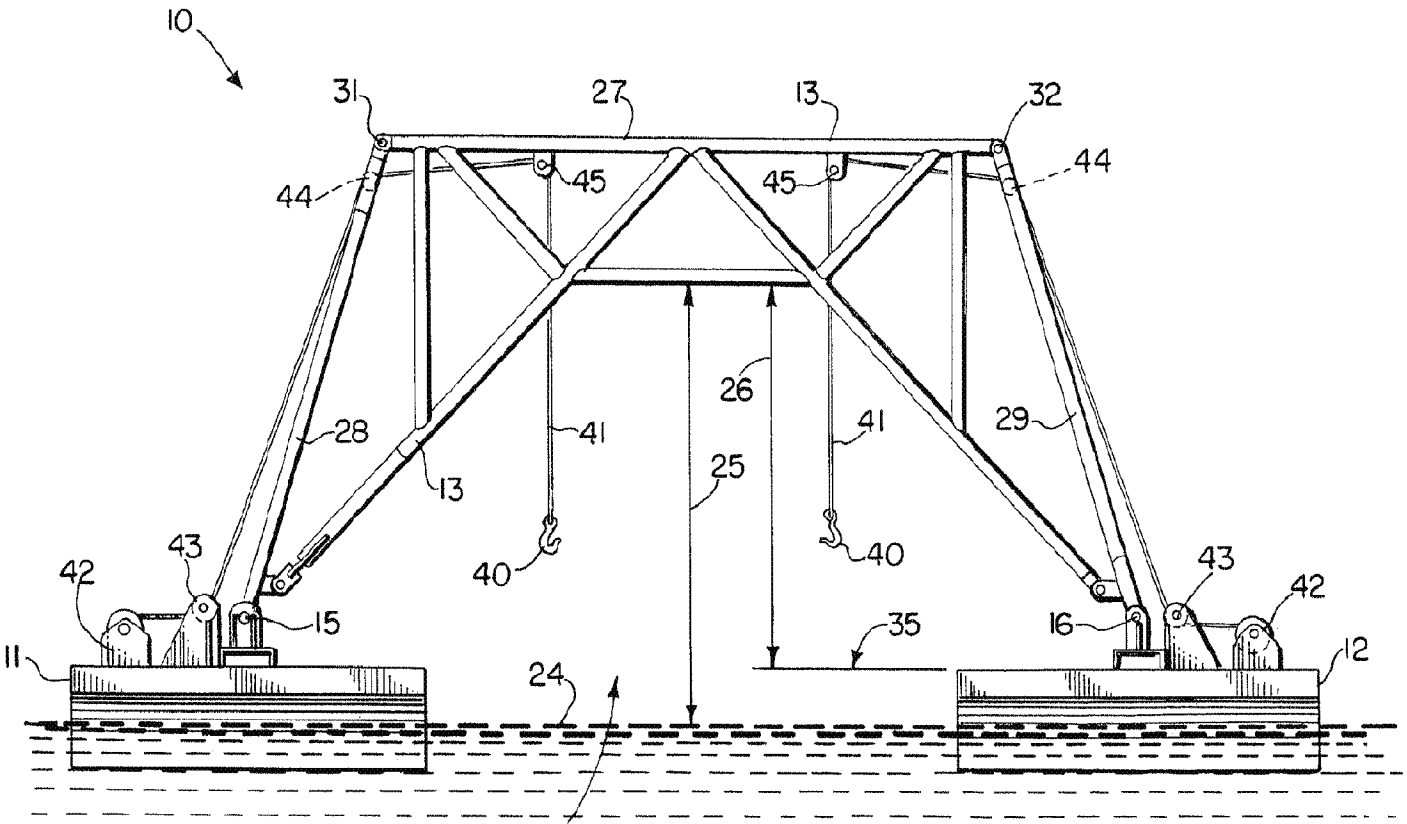
FIG. 3 is an end elevation view of the preferred embodiment of the apparatus of the present invention, with each winch and lifting line removed for clarity.

In FIG. 3, a clearance between water surface 24 and frame 13 or 14 is indicated schematically by the dimension line 25. Similarly, a clearance 26 is provided above the maximum deck elevation 35 of the hulls 11, 12 as shown in FIG. 3.

Each of the frames 13, 14 can be in the form of a truss as shown. The frames are generally speaking in the shape of an arch or inverted U so that an area is provided under the frames and above the water surface for raising an item that is being salvaged or to lift an item from a barge or other vessel or support that is under the frames. Each truss or frame 13, 14 can be a one piece structure (see FIG. 10) or a multi-section truss (see FIGS. 1-4). For multi-section frames 13, 14 they provide a center truss section 27, a smaller side truss section 28 and another smaller side truss section 29. Pinned connections 31, 32 can be provided for attaching the smaller truss sections 28, 29 to the larger center truss section 27 as shown in FIGS. 3 and 4.

Slings can optionally be provided for connecting the center section 27 to the lower end portion of each of the smaller truss sections 28, 29. Shackles can be used to attach each of the slings to eyelets or padeyes on the center section 27. Likewise, shackles can be used to attach the slings to eyelets or padeyes on the smaller truss sections 28, 29.

Figure 13:
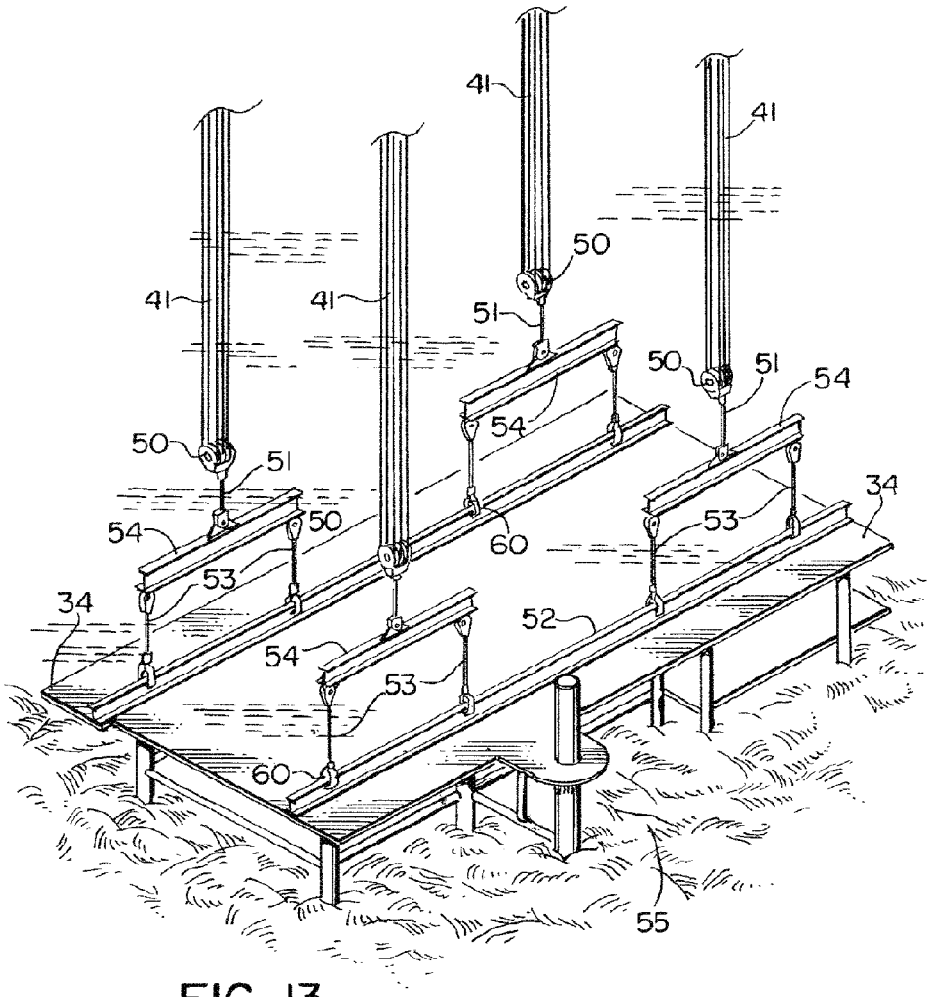
FIG. 13 is a partial perspective view of the preferred embodiment of the apparatus of the present invention and showing a method step of the present invention.

A hook 40 or other lifting fitting can be attached to a lifting line 41 and payed out from winch 42. More than one lifting line 41 and hook 40 can be provided as shown. Sheaves 43, 44, 45 as needed can be used to route the line 41 from winch 42 to hook 40. Line 41 can be a multiple line assembly to increase lift capacity such as is shown in FIG. 13. Hook 40 can be any lifting fitting such as any known commercially available crown block, for example.

Figure 6:
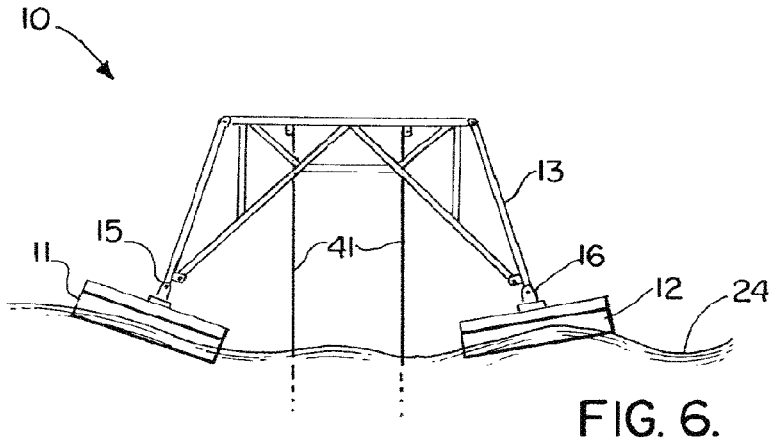
FIGS. 6-8 are schematic illustrations of a rough sea condition.
Figure 7:
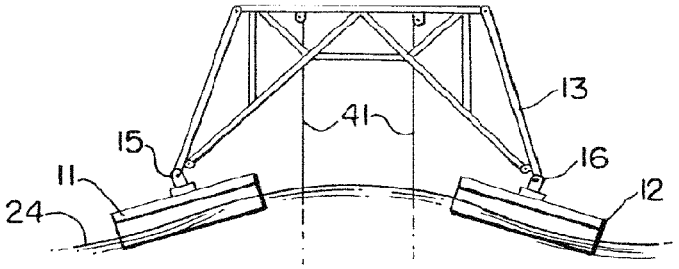
Figure 8:
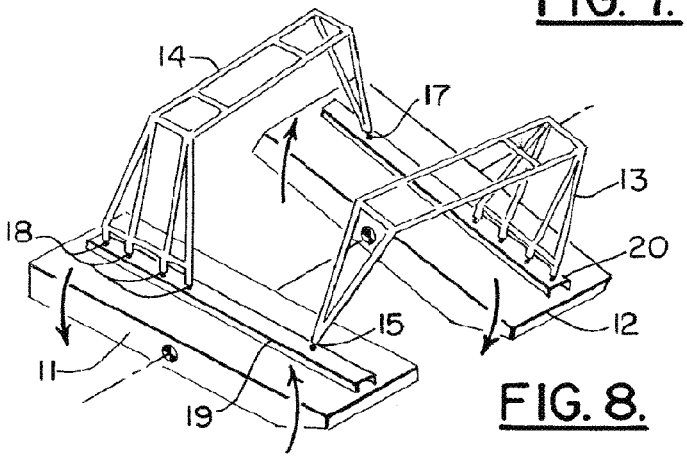
Figure 9A:
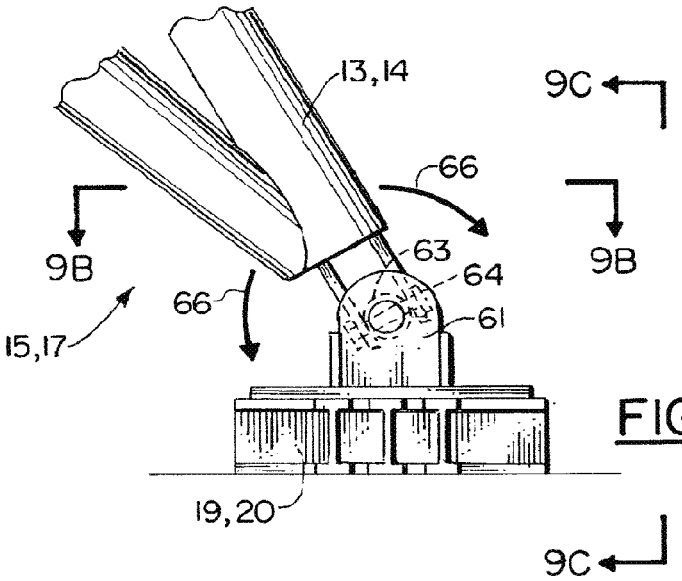
Figure 9B:
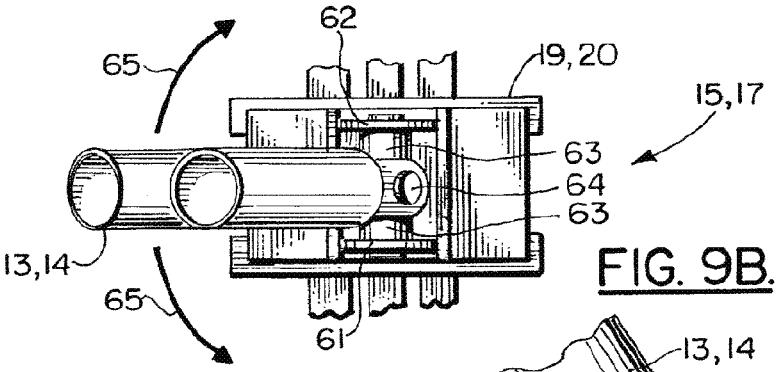
Figure 9C:
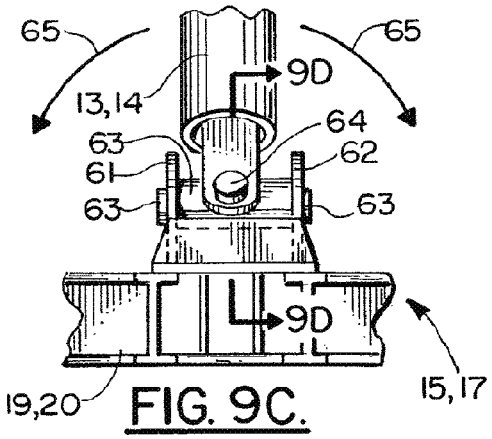
Figure 9D:
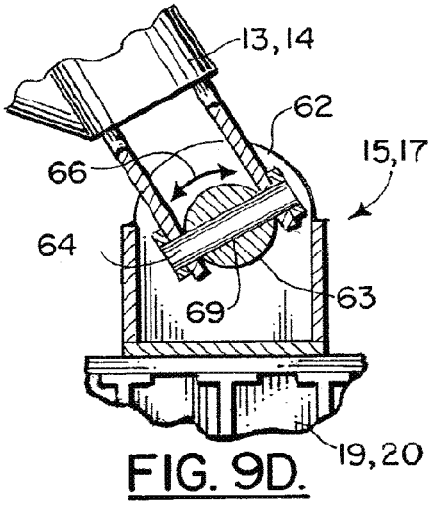

FIGS. 6-9 illustrate the articulation that is achieved with the method and apparatus of the present invention, even in rough seas. In FIGS. 6 and 7, rough sea conditions are shown wherein the vessels 11, 12 assume differing orientations relative to each other caused by the rough sea state. Notwithstanding the orientation of the vessels 11, 12 the combination of an articulating connection 15, 17 with hinged or pinned connections 16, 18 enables complete articulation between each of the frames or trusses 13, 14 and each of the vessels or hulls 11, 12.

In FIGS. 9A-9D, an exemplary articulating connection 15, 17 is shown. In FIGS. 9A-9D, a frame or truss 13, 14 connects to a load spreader platform 19 or 20 at padeyes 61, 62. A first shaft 63 is pivotally attached to the padeyes 61, 62. A second shaft 64 is pivotally attached to the first shaft 63 at opening 69 in first shaft 63. The second shaft 64 also defines a pivotal connection for the frame 13 or 14 to the first shaft 63 as shown. This universal joint arrangement enables the frame 13 (or 14) to move in an articulating fashion with respect to the load spreader platform 19 or 20 and with respect to the underlying vessel 11 or 12 as indicated schematically by arrows 65, 66 in FIGS. 9A-9D.

FIGS. 10-17 show the preferred embodiment of the apparatus of the present invention when fitted with a block and tackle arrangement. Vessels 11, 12 are also shown fitted with anchor lines 67 that connect conventional anchors (not shown) to anchor winches 68 on the vessels 11, 12. The anchor winches 68 can be used to exactly position vessels 11, 12 and to stabilize their positions during a lift. A block and tackle arrangement (FIGS. 10-17) can be used to lift an item to be salvaged from the seabed 55 such as the damaged platform section 34 in FIG. 12.

Figure 10:
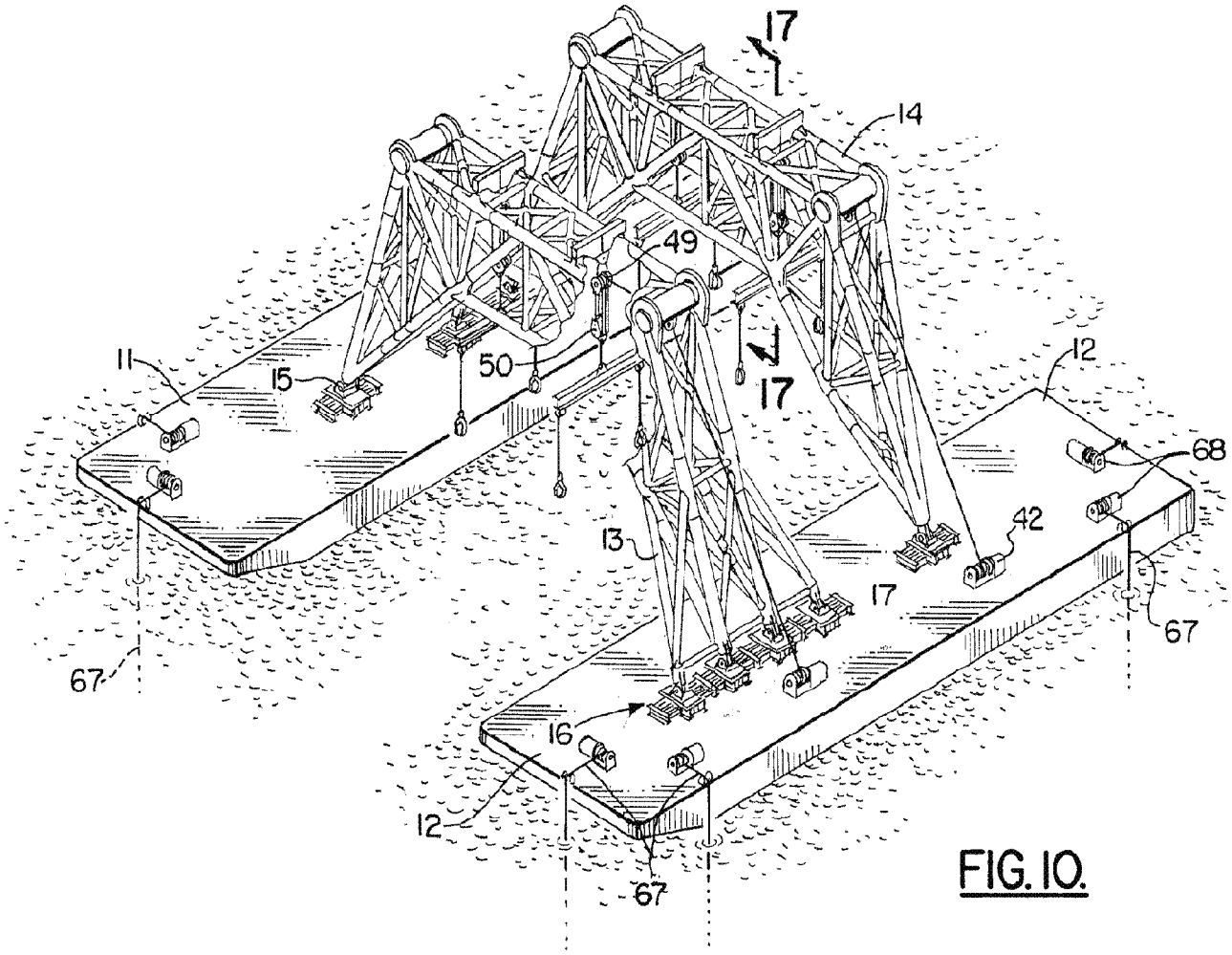
FIG. 10 is a perspective view of the preferred embodiment of the apparatus of the present invention showing a block and tackle rigging with winches and lift lines.
Figure 11:
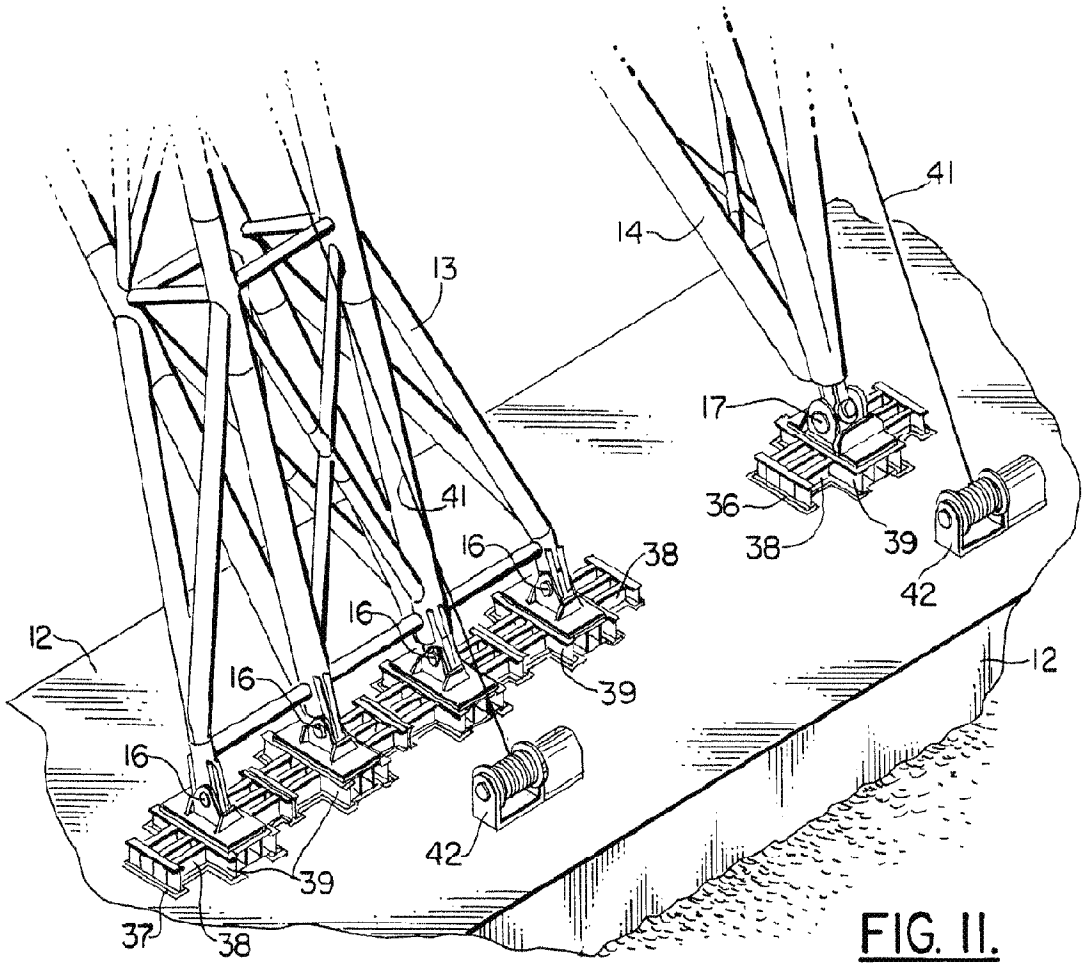
FIG. 11 is a fragmentary perspective view of the preferred embodiment of the apparatus of the present invention.
Figure 12:
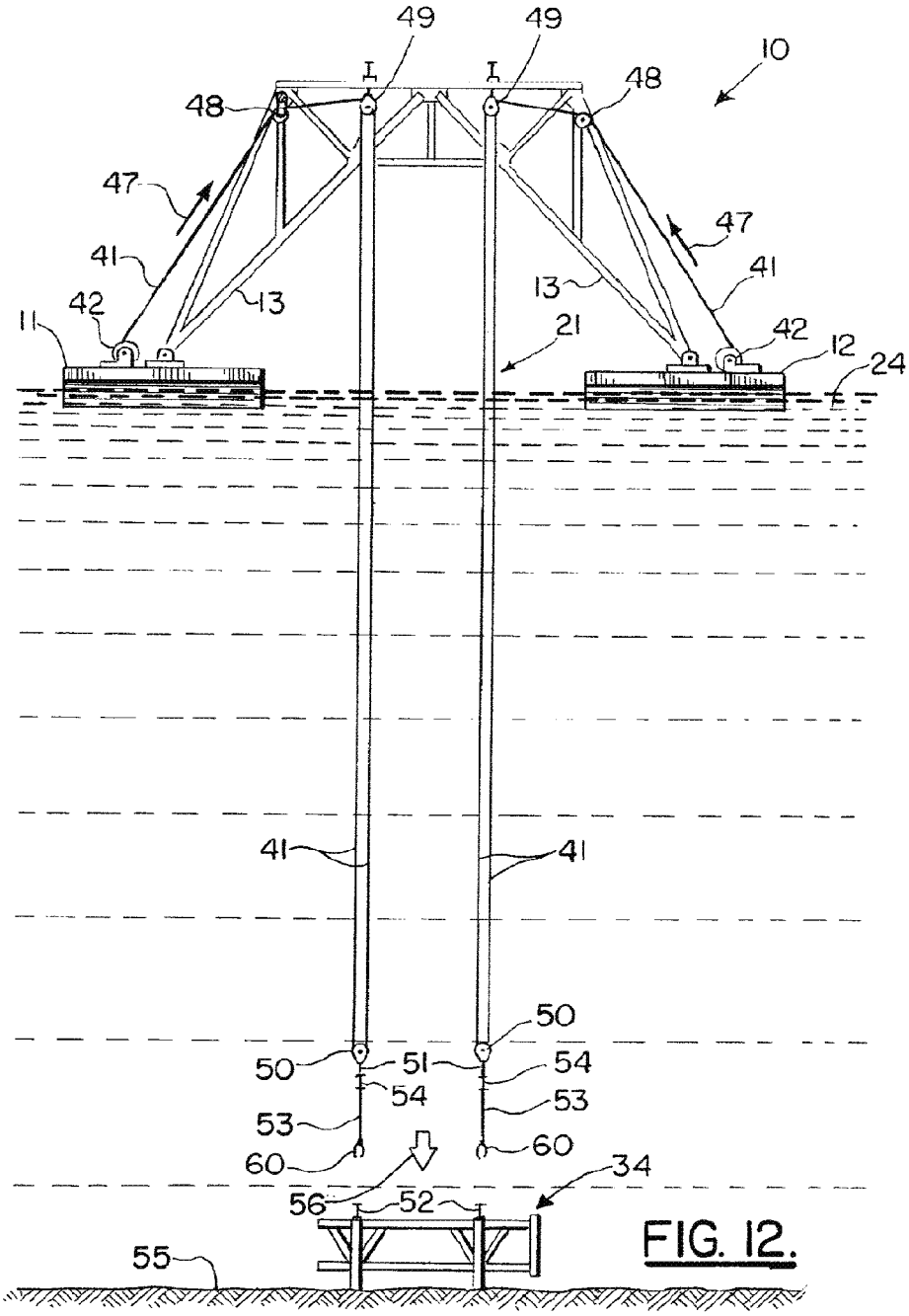
FIG. 12 is an elevation view of the preferred embodiment of the apparatus of the present invention and showing a method step of the present invention.
Figure 15:
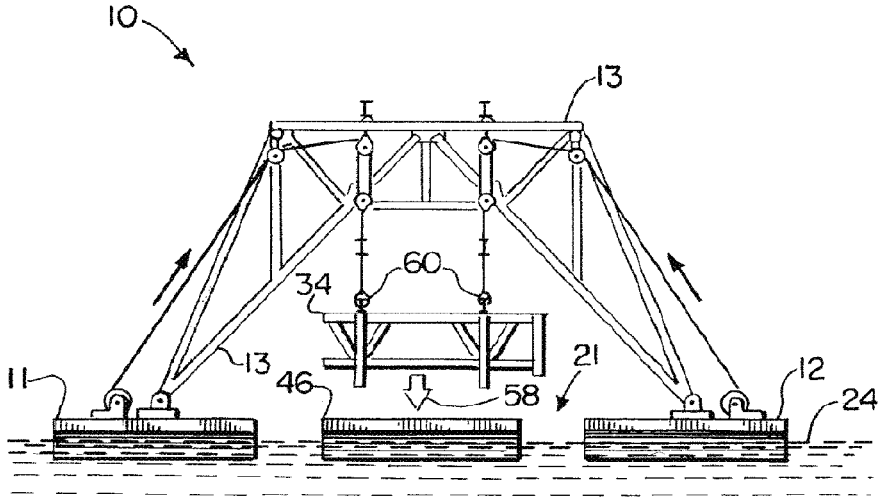
FIGS. 15-16 are elevation views that further illustrate the method of the present invention.
Figure 16:
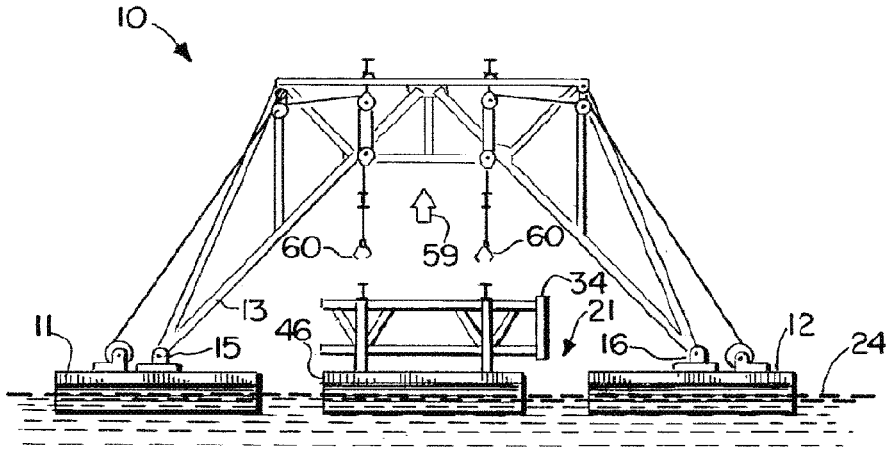
Figure 17:
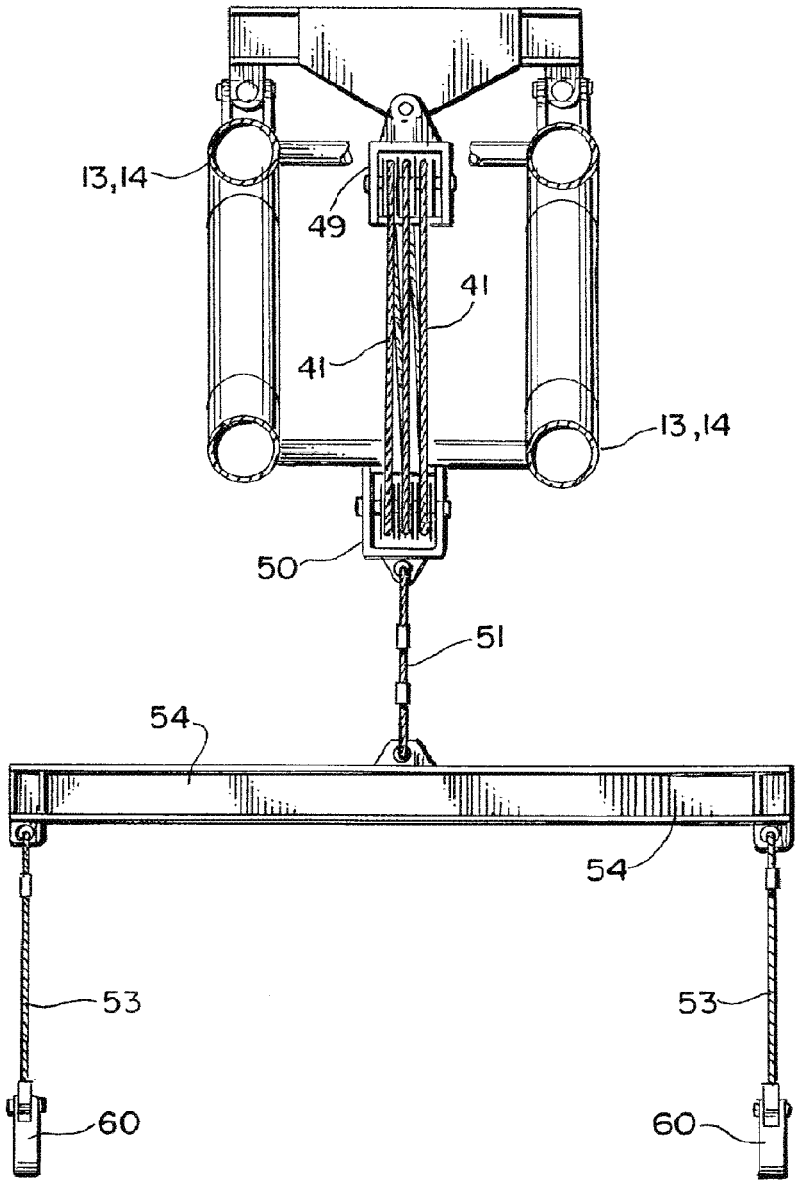
FIG. 17 is a sectional view taken along lines 17-17 of FIG. 10.

In FIGS. 10-17, each of the frames 13, 14 is rigged with an upper sheave 48 and upper pulley block 49. Each frame 13 or 14 can be rigged with a lifting line 41 and one or more winches 42. In FIGS. 10-12 for example, each frame 13, 14 has two winches 42, each winch 42 having a lifting line or cable 41. Lower pulley block 50 is positioned below upper pulley block 49. The pulley blocks 49, 50 can pro vide multiple pulleys such as is shown in FIGS. 10, 13 and 17. Slings 51 can be rigged to each lower pulley block 50. Each sling 51 can support a lifting beam or spreader bar 54. Each spreader bar 54 can support one or more slings 53 as shown in FIGS. 12, 17. The slings 53 can be provided with any selected additional rigging such as clamps, shackles or grabs 60, as examples. Arrows 47 in FIG. 12 show lines 41 being payed out to lower the lower pulley blocks 50 to damaged platform section 34 (see arrow 56, FIG. 12).

Figure 14:
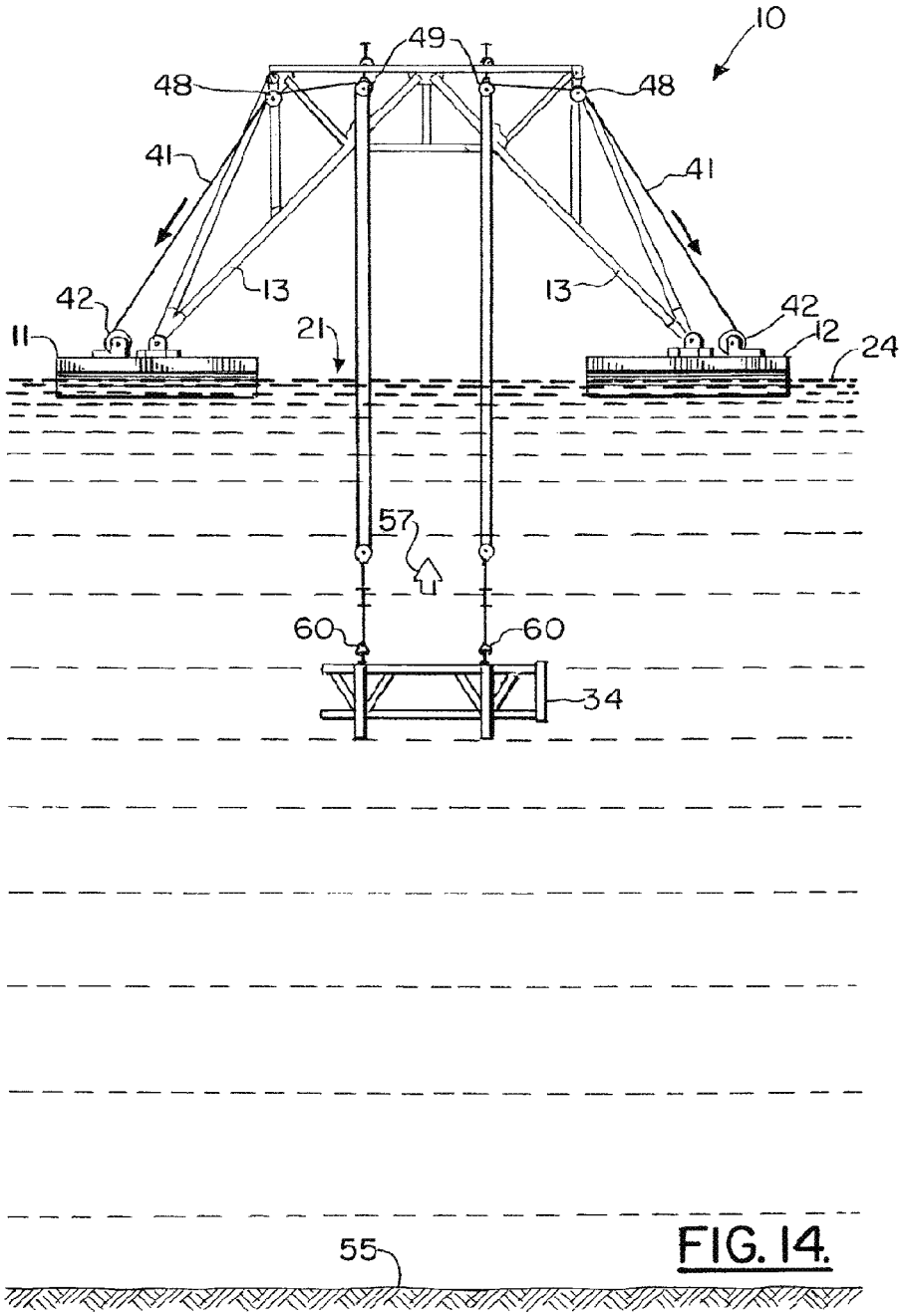
FIG. 14 is an elevation view of the preferred embodiment of the apparatus of the present invention and illustrating the method of the present invention.

The damaged platform section 34 to be salvaged can be fitted with beams 52 such as I-beams as an example. As the damaged or sunken platform section 34 rests upon seabed 55, grabs 60 can be attached to the beams 52 with slings 53 as shown in FIG. 12 for a lifting operation. Arrow 56 in FIG. 12 schematically illustrates a lowering of the lower pulley blocks 50 to the sunken, damaged platform section 34. After the grabs 60 are connected to the beams 52, arrow 57 in FIG. 14 schematically illustrates an elevating of the platform section 34 as each line 41 is wound upon its winch 42.

In FIG. 15, the transport vessel 46 is moved into the area 21 under frames 13, 14. Arrow 58 schematically illustrates a lowering of the damaged platform section 34 to the vessel 46. In FIG. 16, grabs 60 have been released from beams 52 and lifted upwardly in the direction of arrow 59, away from the damaged platform section 34. The damaged or salvaged item such as a vessel 33 or damaged platform section 34 can then be transported to a selected locale using the transport vessel or transport barge 46.

In FIG. 11, an alternate load spreader platform construction is shown. A smaller load spreader platform 36 is placed under each universal joint 15 or 17 of the frame 13 or 14. A larger load spreader platform 37 is placed under each pinned connection or hinge 16 or 18 of the frame 13 or 14. Each platform 36, 37 can comprise a plurality of longitudinal beams 38 and a plurality of transverse beams 39 as shown. The beams 38, 39 can be structurally connected together (e.g. welded together).

Figure 20:
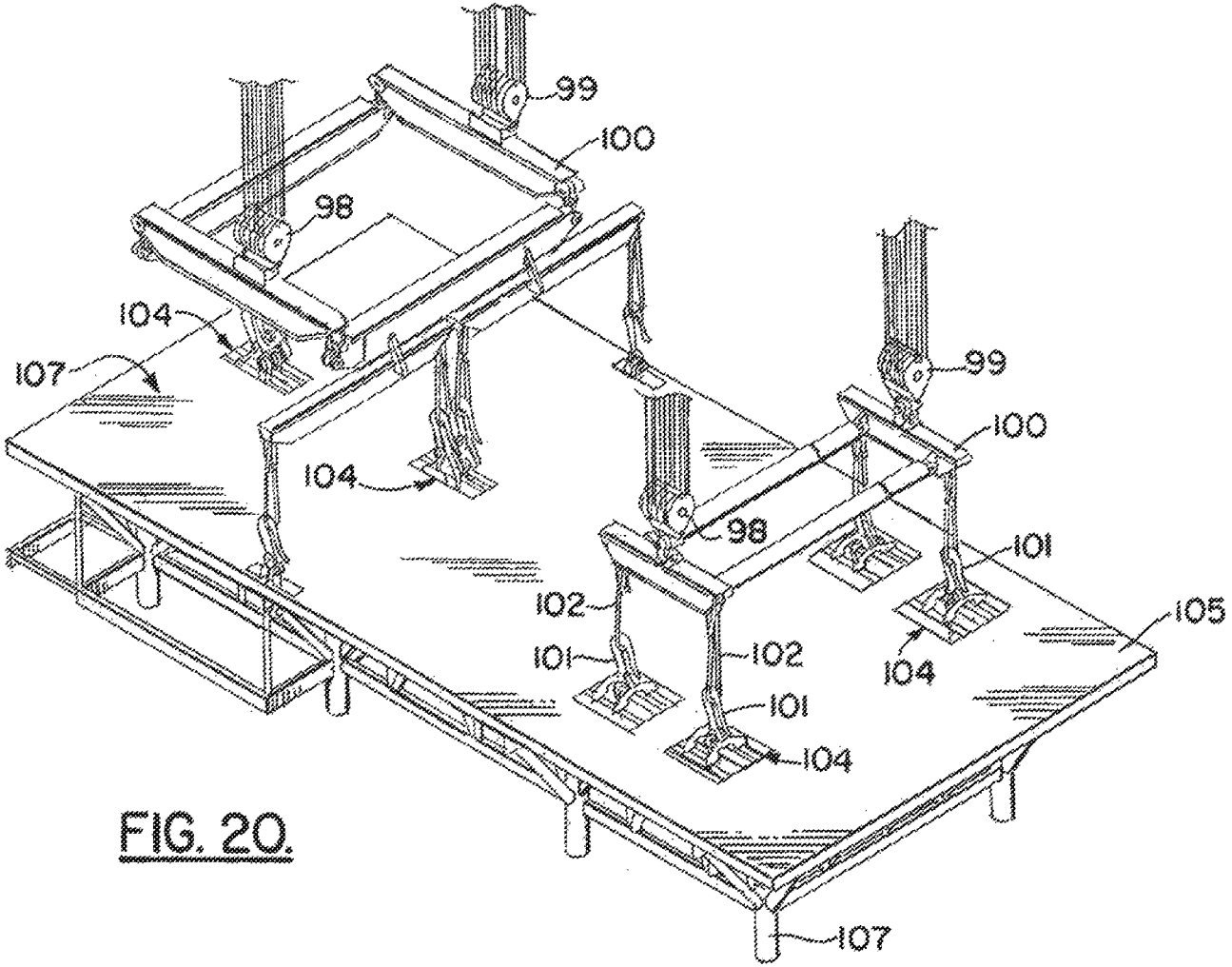
FIG. 20 is a fragmentary, perspective view of the second embodiment of the apparatus of the present invention.
Figure 21:
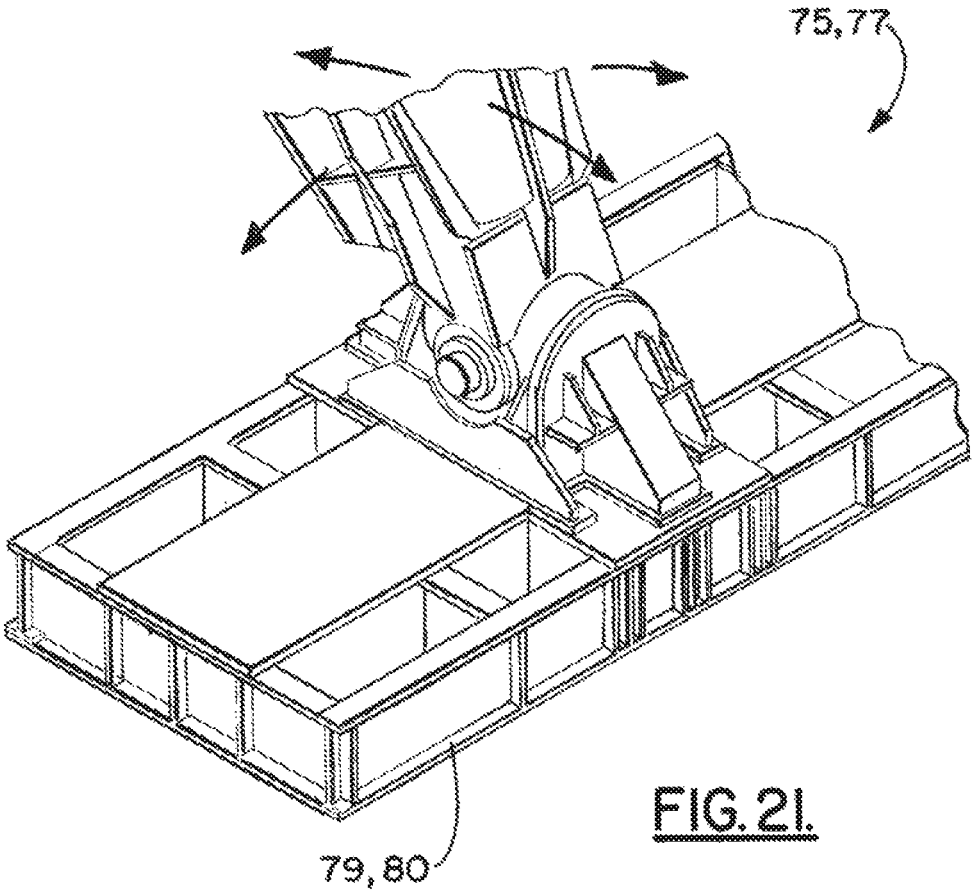
FIG. 21 is a partial, perspective view of the second embodiment of the apparatus of the present invention.

FIGS. 18-24 show a second embodiment of the apparatus of the present invention designated generally by the numeral 70. As with the preferred embodiment of FIGS. 1-17, the second embodiment of FIGS. 18-24 provides a marine lifting apparatus 70 that employs two vessels or hulls 71, 72. The vessels or hulls 71, 72 support a pair of frames 73, 74. Each frame 73, 74 is attached to each of the vessels 71, 72 using a universal joint and a hinge. The frame 73 attaches to the vessel 71 using universal joint 75 and to vessel 72 using hinge 76. Similarly, the frame 74 attaches to vessels 71 using hinge 78 and to vessel 72 using universal joint 77. The universal joint 75 of the frame 73 and the universal joint of the frame 74 are on different vessels as shown. Each of the frames 73, 74 interfaces with the vessels 71, 72 via universal joints and hinges and optionally with a load spreader platform interface 79, 80. FIG. 21 shows more particularly a load spreader platform interface 79, 80 and a universal joint 75, 77.

Figure 18:
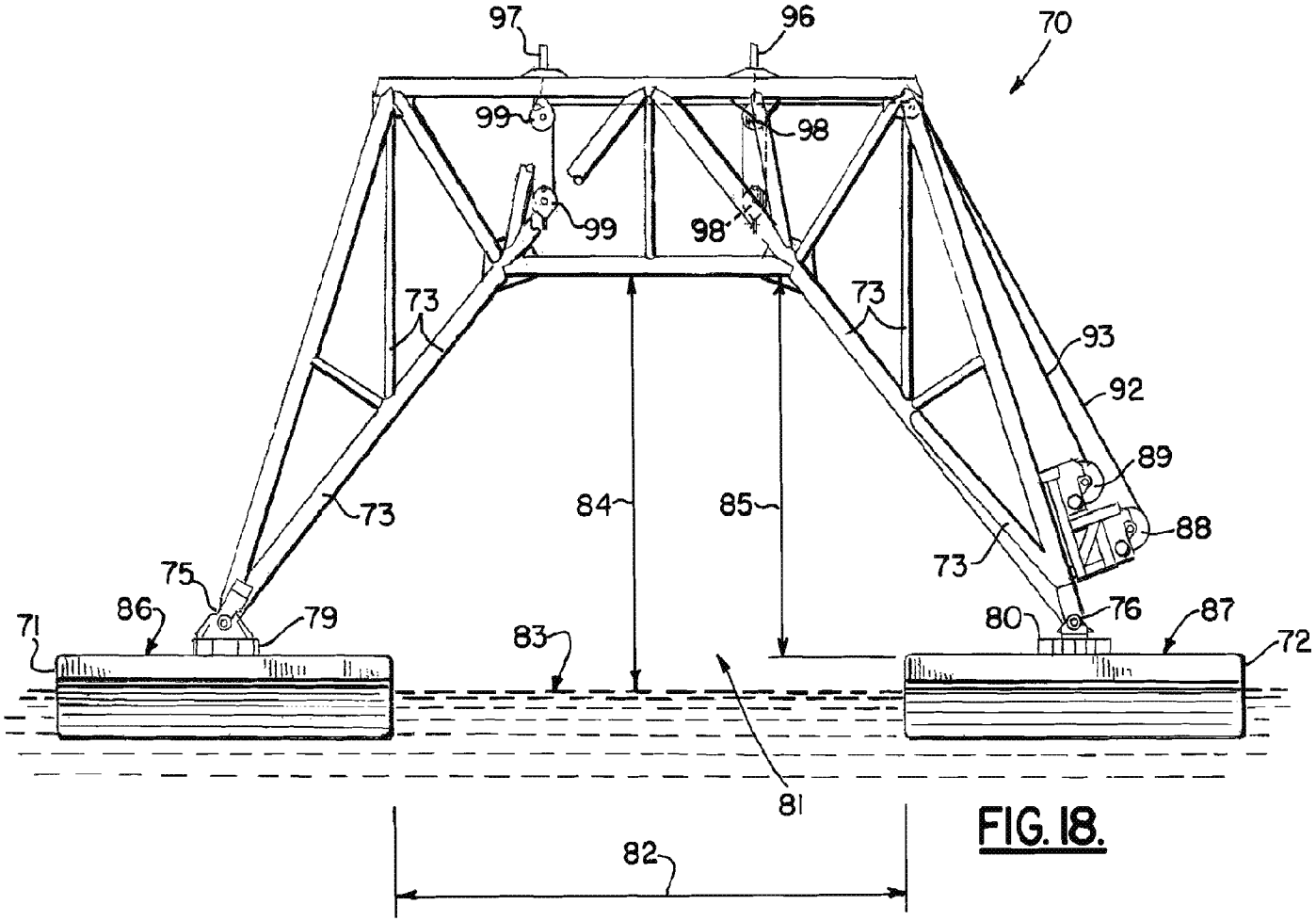
FIG. 18 is a elevation view of a second embodiment of the apparatus of the present invention.
Figure 19:
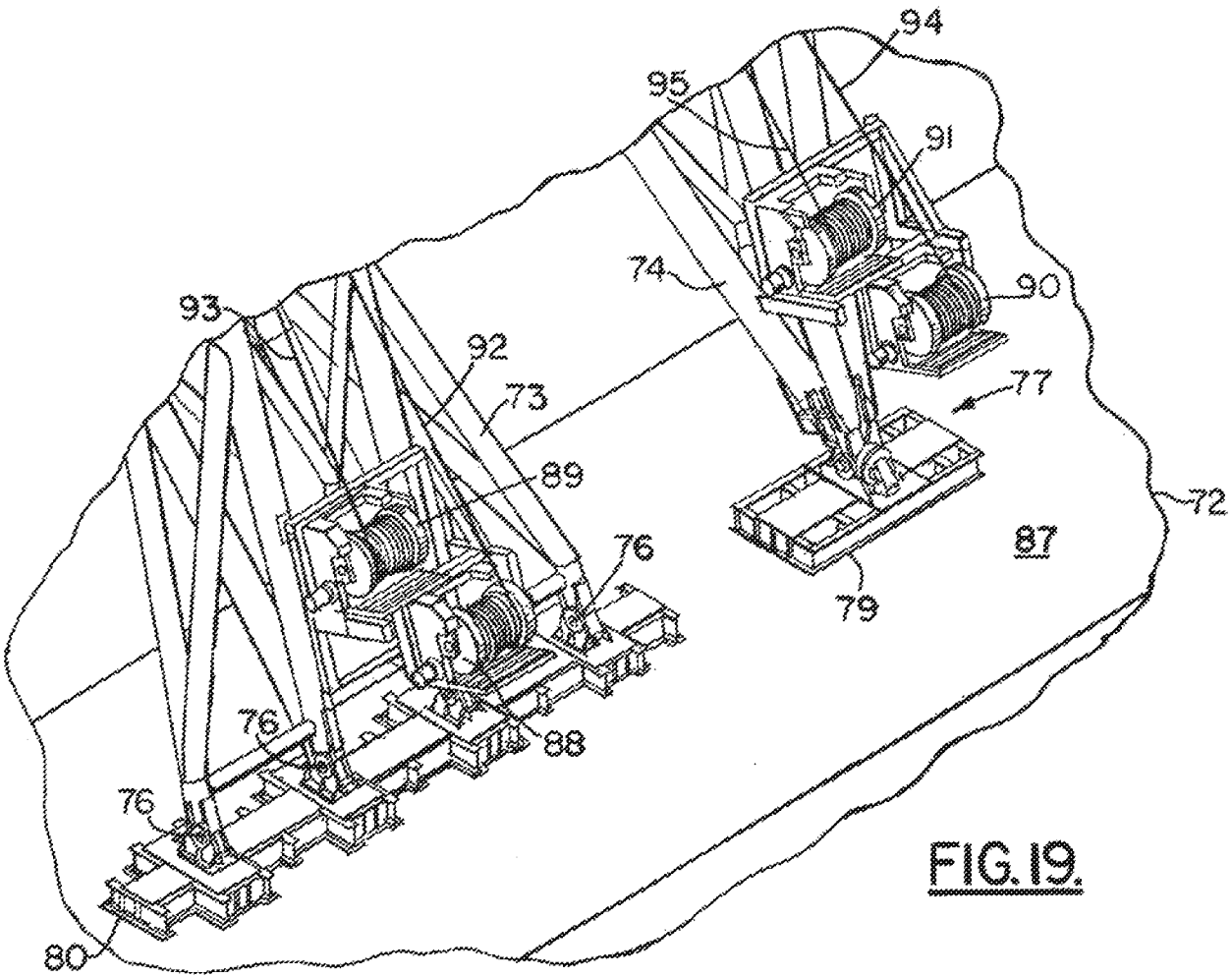
FIG. 19 is a plan fragmentary view of the second embodiment of the apparatus of the present invention.

An area 81 is provided in between each of the vessels 71, 72 as shown in FIG. 18 and under each of the frames 73, 74. In FIG. 18, dimension line 84 indicates the clearance between water surface 83 and each frame 73 or 74. The dimension line 85 indicates the clearance above the hull deck 86 or 87 of vessel 71 or 72 as shown. The dimension line 82 can be the width of the area 81 in between the barges or vessels 71, 72, indicated by the dimension line in FIG. 18 that is labeled with reference numeral 82.

A plurality of winches 88-91 are provided, two (2) winches 88, 89 or 90, 91 for each frame 73, 74. Each of the winches 88-91 provides a winch line that enables the winch to lift objects from a seabed or from the water surface area 83 via a crown block or block and tackle arrangement as shown in the drawings. The winch 88 provides a winch line 92. The winch 89 provides a winch line 93. The winches 88, 89 are mounted upon frame 73 as shown in FIG. 18. The winches 90, 91 are mounted upon the frame 74 as shown in FIG. 20. Winch 90 provides winch line 94. Winch 91 provides winch line 95.

Each frame 73, 74 is preferably in the form of a truss. In FIG. 18, each frame 73, 74 provides a pair of spaced apart beams 96, 97 that are used to support a crown block 98 or 99 or other lifting arrangement such a block or tackle or the like.

In the embodiment of FIGS. 18-24, there is provided for example two winches 88, 89 or 90, 91 for each frame 73 or 74. Each winch 88-91 is rigged to one of the beams 96, 97 using sheaves or other rigging. Each beam 96, 97 supports a crown block 98, 99, block and tackle or other lifting arrangement that affords mechanical advantage when the winches 88-91 are wound in a selected direction for either paying out or reeling in the respective winch lines 92-95.

An example of an underwater object to be salvaged is shown in FIG. 20 in the form of a platform 107. In FIG. 20, a plurality of crown blocks 98, 99 attach to a lifting frame or frames or spreaders 100. Each of the lifting frames or spreaders 100 is used to lift deck 107 using a plurality of hooks 101 and slings 102, 103. Each of the slings 102 is a sling that extends in between a lifting frame 100 and a hook 101.

With the method of the present invention, openings 104 can be cut in deck 105 of platform 107. In this fashion, slings 103 can extend downwardly from hooks 101 to underdeck beams 106 that are shown in phantom lines in FIG. 22.

Figure 22:
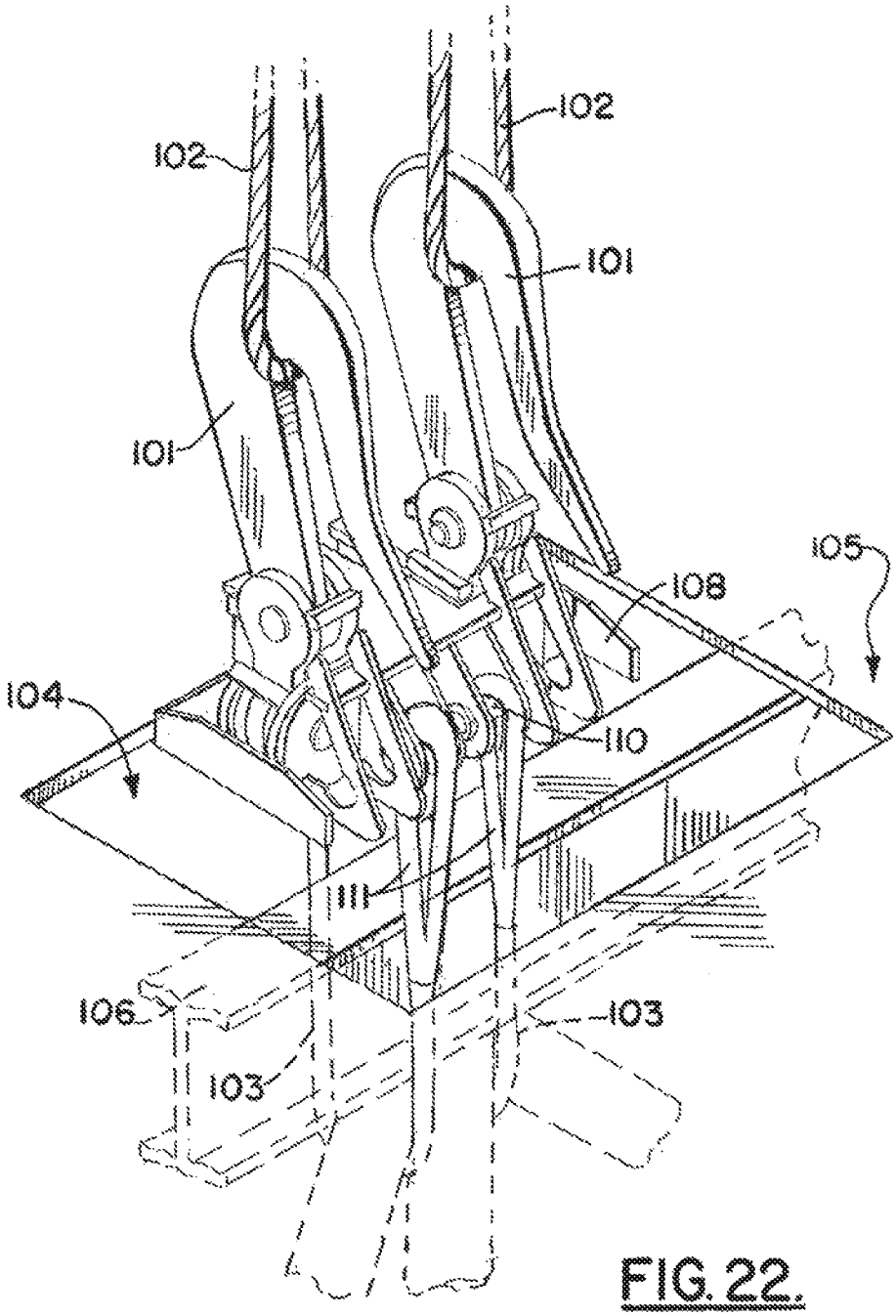
FIG. 22 is a partial, perspective view of the second embodiment of the apparatus of the present invention.
Figure 23:
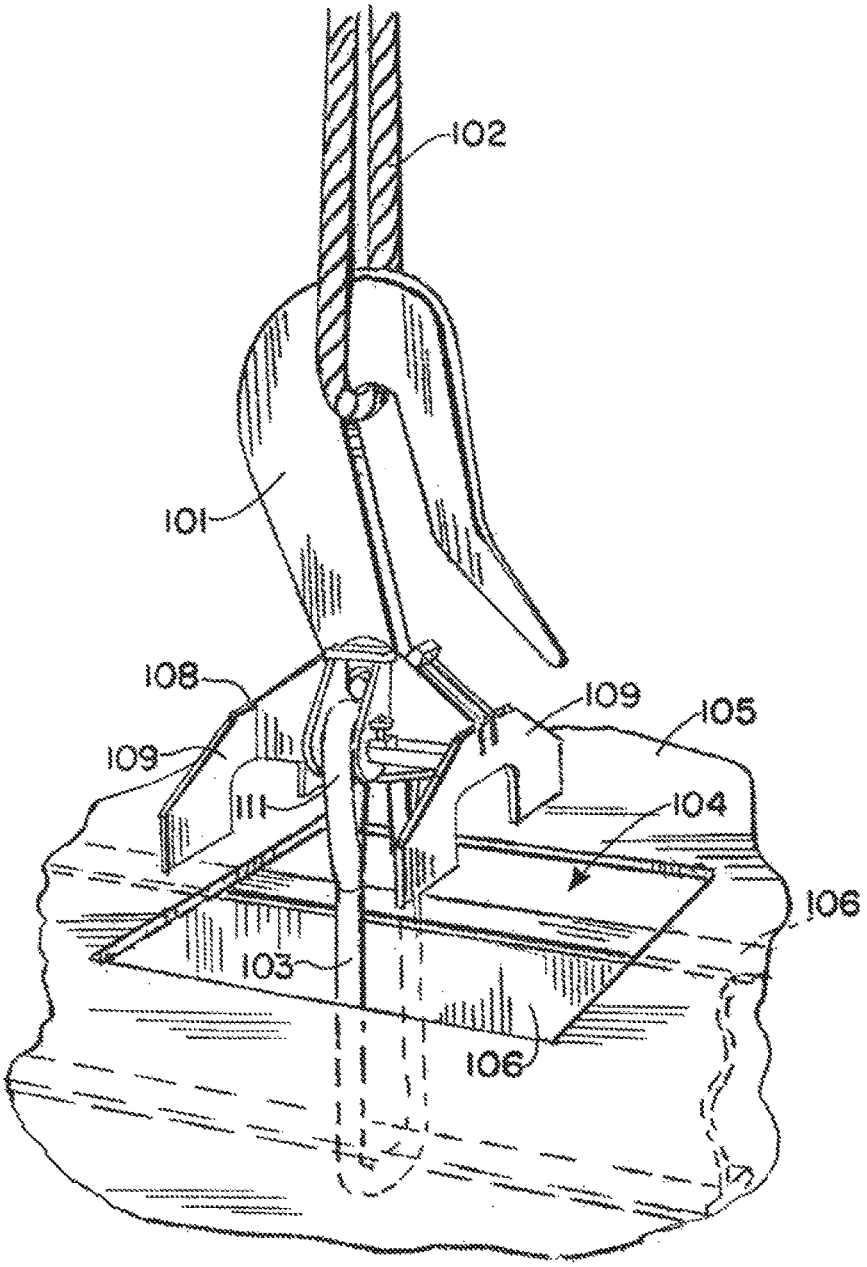
FIG. 23 is a partial, perspective view of the second embodiment of the apparatus of the present invention.
Figure 24:
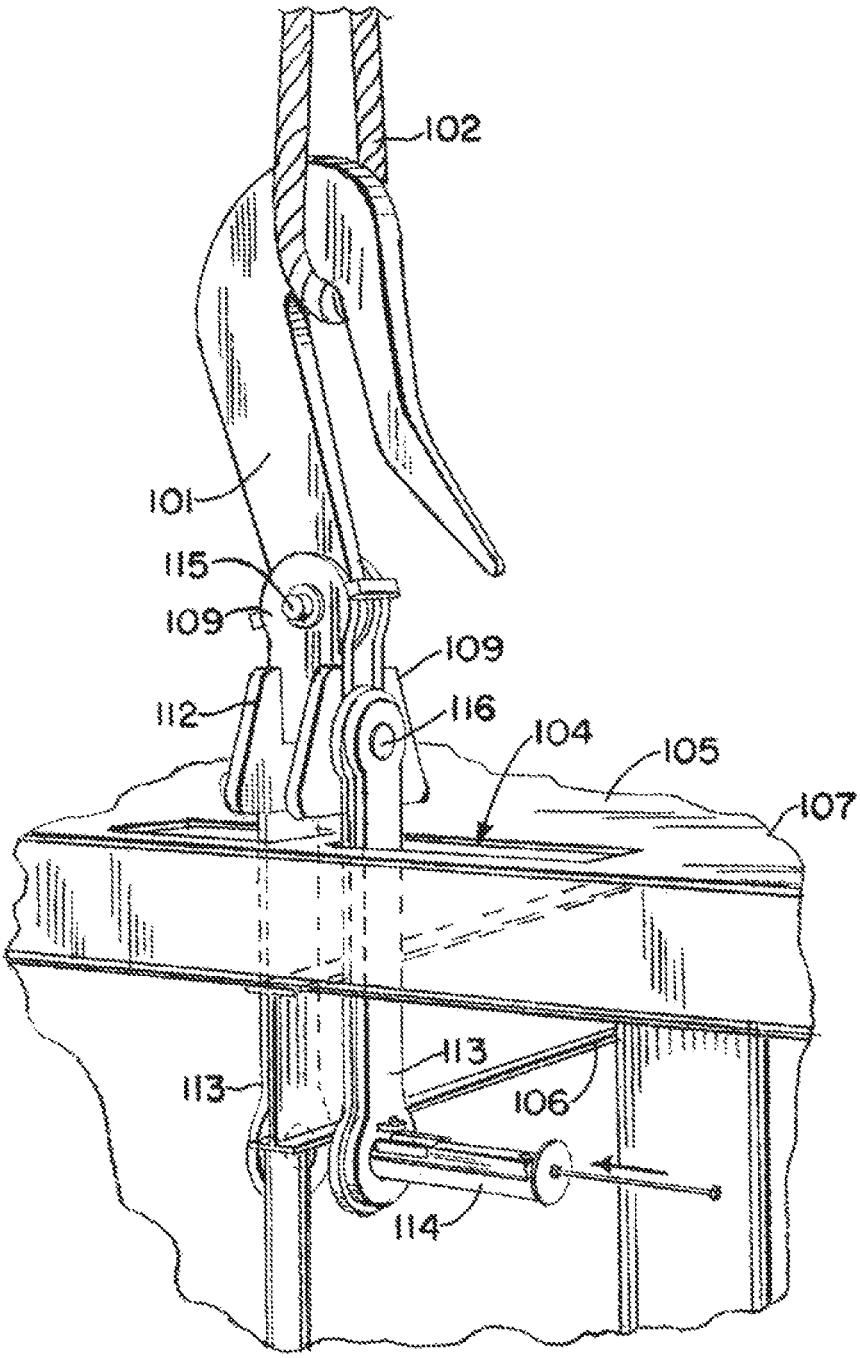
FIG. 24 is a partial, perspective view of the second embodiment of the apparatus of the present invention.

In order to ensure that the hooks 101 do not fall through the openings 104, each hook 101 is provided with a base structure 108 that can be fabricated of a plurality of plates 109 that are welded together and shafts 110 spanning between adjacent plates 109. Shafts 110 are receptive of the loops 111 of the slings 103 as shown in FIGS. 22-23. Examples of hook and base structure arrangements are seen in FIGS. 22 and 23. In FIG. 24, a base structure 112 employs a plurality of links 113 that extend through an opening 104 (e.g. cut opening) in deck 105 and wherein a pinned connection 114 extends through the links 113 and beneath an underdeck beam 106 as shown. Hook 101 of FIG. 24 can attach via pinned connections 115, 116 and plates 109 to the links 113.

The following is a list of parts and materials suitable for use in the present invention.

Parts List

| Part Number | Description |
|---|---|
| 10 | marine lifting apparatus |
| 11 | vessel |
| 12 | vessel |
| 13 | first frame or truss |
| 14 | second frame or truss |
| 15 | universal joint |
| 16 | hinge |
| 17 | universal joint |
| 18 | hinge |
| 19 | load spreader platform interface |
| 20 | load spreader platform interface |
| 21 | area |
| 22 | dimension line |
| 23 | dimension line |
| 24 | water surface |
| 25 | clearance above water |
| 26 | clearance above hull deck |
| 27 | center truss section |
| 28 | smaller truss section |
| 29 | smaller truss section |
| 30 | hull deck |
| 31 | pinned connection |
| 32 | pinned connection |
| 33 | sunken vessel |
| 34 | damaged platform section |
| 35 | maximum deck elevation |
| 36 | load spreader platform |
| 37 | load spreader platform |
| 38 | longitudinal beam |
| 39 | transverse beam |
| 40 | lifting hook |
| 41 | lifting line |
| 42 | winch |
| 43 | sheave |
| 44 | sheave |
| 45 | sheave |
| 46 | transport vessel |
| 47 | arrow |
| 48 | upper sheave |
| 49 | upper pulley block |
| 50 | lower pulley block |
| 51 | sling |
| 52 | beam |
| 53 | sling |
| 54 | spreader bar |
| 55 | scabed |
| 56 | arrow |
| 57 | arrow |
| 58 | arrow |
| 59 | arrow |
| 60 | grab |
| 61 | padeye |
| 62 | padeye |
| 63 | first shaft |

-continued

| Part Number | Description |
|---|---|
| 64 | second shaft |
| 65 | arrow |
| 66 | arrow |
| 67 | anchor line |
| 68 | anchor winch |
| 69 | opening |
| 70 | marine lifting apparatus |
| 71 | vessel |
| 72 | vessel |
| 73 | frame |
| 74 | frame |
| 75 | universal joint |
| 76 | hinge |
| 77 | universal joint |
| 78 | hinge |
| 79 | load spreader platform interface |
| 80 | load spreader platform interface |
| 81 | area |
| 82 | dimension line |
| 83 | water surface area |
| 84 | clearance above water |
| 85 | clearance above hull deck |
| 86 | hull deck |
| 87 | hull deck |
| 88 | winch |
| 89 | winch |
| 90 | winch |
| 91 | winch |
| 92 | winch line |
| 93 | winch line |
| 94 | winch line |
| 95 | winch line |
| 96 | beam |
| 97 | beam |
| 98 | crown block |
| 99 | crown block |
| 100 | frame/spreader |
| 101 | hook |
| 102 | sling |
| 103 | sling |
| 104 | opening |
| 105 | deck |
| 106 | underdeck beam |
| 107 | platform |
| 108 | base structure |
| 109 | plates |
| 110 | shaft |
| 111 | loop |
| 112 | base structure |
| 113 | link |
| 114 | pinned connection |
| 115 | pinned connection |
| 116 | pinned connection |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A method of salvaging an underwater object, comprising the steps of:

(a) providing first and second floating hulls which are spaced apart, and having a first frame spanning between the first and second floating hulls, and a second frame spanning between the first and second hulls, wherein
(i) the first frame having
not more than a single axis of rotation
relative to the first floating hull and
two non-parallel axes of rotation
relative to the second floating hull;
(ii) the second frame having
two non-parallel axes of rotation
relative to the first floating hull and
not more than a single axis of rotation
relative to the second floating hull;
and
(iii) cabling that extends downwardly from the first and second frames;
(b) lifting the underwater object with
the cabling that extends downwardly from the first and second frames while the first or second hull moves relative to the first or second frame
wherein, in responding to wave action,
(i) the first frame moves relative to the first floating hull about not more than its single axis of rotation
relative to the first floating hull
while simultaneously,
the second frame moves relative to the first floating hull about its two non-parallel axes of rotation
relative to the first floating hull; and
(ii) the second frame moves relative to the second floating hull
about not more than its single axis of rotation
relative to the second floating hull
while simultaneously,
the first frame moves relative to the second floating hull about its two non-parallel axes of rotation
relative to the second floating hull; and
(iii) with the first and second frames
moving independently of each other and
assuming differing orientations relative to each other.

2. The method of claim 1,
wherein in step (a)
the two non-parallel axes of rotation of the first frame relative to the second floating hull
form a first universal joint,
wherein the first universal joint includes
a first shaft forming one of the two non-parallel axes of rotation of the first frame
relative to the second floating hull, and
a second shaft forming the other of the two non-parallel axes of rotation of the first frame
relative to the second floating hull,
wherein the first shaft of the first universal joint includes
a bore and
the second shaft of the first universal joint
is pivotally connected to the first shaft of the first universal joint
via the bore, and
the two non-parallel axes of rotation of the second frame relative to the first floating hull
form a second universal joint,
wherein the second universal joint includes
a first shaft for the second frame forming one of the two non-parallel axes of rotation
of the second frame relative to the first floating hull, and
a second shaft for the second frame forming the other of the two non-parallel axes
of rotation of the second frame relative to the first floating hull,
wherein the first shaft of the second universal joint includes
a bore and
the second shaft of the second universal joint
is pivotally connected to the first shaft of the second universal joint
via the bore.

3. The method of claim 1, wherein the underwater object to be salvaged
is a platform structure having a deck with deck openings and further comprising the step of
extending rigging through the deck via one or more of the deck openings and
connecting the rigging to the platform structure under the deck.

4. The method of claim 3, wherein the rigging extends between the object to be salvaged and an upper end portion of the first and second frames.

5. The method of claim 1, further comprising
mounting a winch and cabling on the combination of first and second hulls and first and second frames, and further comprising lifting the object to be salvaged with the winch and cabling.

6. A method of salvaging an underwater object, comprising the steps of:
(a) providing first and second floating hulls in a spaced apart configuration, and having
a first frame
spanning between the first and second floating hulls, and
a second frame
spanning between the first and second hulls, and
wherein:
(i) the first frame having
not more than a single degree of freedom
relative to the first floating hull and
two degrees of freedom
relative to the second floating hull; and
(ii) the second frame having
two degrees of freedom
relative to the first floating hull and
not more than a single degree of freedom
relative to the second floating hull; and
(iii) a cabling that extends downwardly from the first and second frames;
(b) lifting the underwater object
with the cabling that extends downwardly from the first and second frames
wherein,
in responding to wave action
(i) the first frame's movement relative to the first floating hull
has not more than a single degree of freedom
while simultaneously,
the second frame's movement relative to the first floating hull
has two degrees of freedom; and
(ii) the second frame's movement relative to the second floating hull
has not more than a single degree of freedom
while simultaneously,
the first frame's movement relative to the second floating hull
has two degrees of freedom; and
(iii) with the first and second frames
moving independently of each other and
assuming differing orientations relative to each other.

7. The method of claim 6,
wherein in step (a)
the first frame has
not more than a first single rotational axis
relative to first floating hull, and
a first set of non-parallel rotational axes
relative to the second floating hull, and
the second frame has
not more than a second single rotational axis
relative to the second floating hull, and
a second set of non-parallel rotational axes
relative to the first floating hull.

8. The method of claim 6,
wherein in step (b)
the first set of non-parallel rotational axes
form a first universal joint
of the first frame relative to the second floating hull,
wherein
the first universal joint includes
a first shaft providing one of the first frame's two degrees of freedom
relative to the second floating hull, and
a second shaft forming the other of the first frame's two degrees of freedom
relative to the second floating hull,
wherein
the first shaft of the first universal joint includes
a bore and
the second shaft of the first universal joint
is pivotally connected to the first shaft of the first universal joint
via the bore, and
the second set of non-parallel rotational axes form a second universal joint
of the second frame relative to the first floating hull,
wherein
the second universal joint includes
a first shaft providing one of the second frame's two degrees of freedom
relative to the first floating hull, and
a second shaft forming the other of the second frame's two degrees of freedom
relative to the first floating hull,
wherein
the first shaft of the second universal joint includes
a bore and
the second shaft of the second universal joint
is pivotally connected to the first shaft of the second universal joint
via the bore.

9. The method of claim 6,
wherein the underwater object to be salvaged
is a platform structure having a deck with deck openings and
further comprising the step of
extending rigging through the deck
via one or more of the deck openings and
connecting the rigging to the platform structure under the deck.

10. The method of claim 6,
further comprising
mounting a winch and cabling
on the combination of first and second floating hulls and first and second frames, and further comprising
lifting the object to be salvaged with the winch and cabling.

11. The method of claim 10,
further comprising
attaching rigging that includes
a hook suspended from the cabling and
one or more slings attached to the object to be salvaged and to the hook.

12. The method of claim 6,
wherein in step "b",
the downwardly extending cabling includes
more than one lifting line
along with multiple winds of cabling
rigged to a block and tackle pulley arrangement.

13. The method of claim 6,
further comprising the step of
spanning one or more beams between the first and second frames of step "a", and
in step "b"
the downwardly extending cabling depends from the beams.

14. A method of raising an object from a seabed area in a marine locale comprising the steps of:
(a) transporting a floating catamaran support structure to the marine locale
the catamaran support structure including:
first and second spaced apart catamaran hulls having
a first frame
spanning between the first and second spaced apart catamaran hulls, and
a second frame
spanning between the first and second spaced apart catamaran hulls,
wherein:
(i) the first frame having
not more than a single axis of rotation
relative to the first catamaran hull and
two non-parallel axes of rotation
relative to the second catamaran hull;
(ii) the second frame having
two non-parallel axes of rotation
relative to the first catamaran hull and
not more than a single axis of rotation
relative to the second catamaran hull;
(b) lifting a submerged object from the seabed area
with rigging that is supported by the combination of
floating catamaran support structure and
first and second frames; and
(c) wherein the object lifted in step "b"
is lifted to being next to the first and second frames of step "a"
wherein, in responding to wave action,
(i) the first frame moves relative to the first catamaran hull
about not more than its single axis of rotation
relative to the first catamaran hull
while simultaneously,
the second frame moves relative to the first catamaran hull
about its two non-parallel axes of rotation
relative to the first catamaran hull;
(ii) the second frame moves relative to the second catamaran hull
about not more than its single axis of rotation
relative to the second catamaran hull while simultaneously,
the first frame moves relative to the second catamaran hull
about its two non-parallel axes of rotation
relative to the second catamaran hull; and
(iii) with the first and second frames
moving independently of each other and
assuming differing orientations relative to each other.

15. The method of claim 14,
wherein in step (c)
the two non-parallel axes of rotation of
the first frame relative to the second catamaran hull
form a first universal joint, and
the two non-parallel axes of rotation of
the second frame relative to the first catamaran hull
form a second universal joint,
wherein
(i) the first universal joint includes
a first shaft forming one of the two non-parallel axes of rotation
of the first frame relative to the second catamaran hull, and
a second shaft forming the other of the two non-parallel axes of rotation
of the first frame relative to the second catamaran hull,
wherein
the first shaft of the first universal joint includes
a bore and
the second shaft of the first universal joint
is pivotally connected to the first shaft of the first universal joint
via the bore; and
(ii) the second universal joint includes
a first shaft forming one of the two non-parallel axes of rotation
of the second frame relative to the first catamaran hull, and
a second shaft forming the other of the two non-parallel axes of rotation
of the second frame relative to the first catamaran hull,
wherein
the first shaft of the first universal joint includes
a bore and
the second shaft of the first universal joint
is pivotally connected to the first shaft of the first universal joint
via the bore.

16. The method of claim 14,
wherein the submerged object to be salvaged
is a platform structure having a deck with deck openings and
further comprising the step of
extending rigging through the deck
via one or more of the deck openings and
connecting the rigging to the platform structure under the deck.

17. The method of claim 16,
wherein the rigging extends between
the object to be salvaged and
an upper end portion of the first and second frames.

18. The method of claim 17,
further comprising
mounting a winch and cabling
on the combination of
first and second catamaran hulls and
first and second frames, and
further comprising
lifting the object to be salvaged with the winch and cabling.

19. The method of claim 18,
further comprising
attaching rigging that includes
a hook suspended from the cabling and
one or more slings attached to the object to be salvaged and to the hook.

20. The method of claim 14,
wherein in step "b",
the rigging includes
more than one lifting line
along with multiple winds of cabling
rigged to a block and tackle pulley arrangement.

21. The method of claim 14,
further comprising the step of
spanning one or more beams between the first and second frames of step "a", and
in step "b"
the rigging depends from the beams.

22. A method of salvaging an underwater object, comprising the steps of:
(a) providing first and second spaced apart floating hulls having
a first frame
spanning between the first and second spaced apart floating hulls, and
a second frame
spanning between the first and second spaced apart floating hulls,
wherein:
(i) the first frame having
a first set of axes of rotation
connecting it to the first floating hull and
a second set of axes of rotation
connecting it to the second floating hull,
wherein
the second set of axes of rotation includes
a greater number of axes of rotation
than the first set of axes of rotation;
(ii) the second frame having
a third set of axes of rotation
connecting it to the first floating hull and
a fourth set of axes of rotation
connecting it to the second floating hull,
wherein
the third set of axes of rotation includes
a greater number of axes of rotation
than the fourth set of axes of rotation; and
(iii) a cabling that extends downwardly from the first and second frames;
(b) lifting the underwater object
with the cabling that extends downwardly from the first and second frames, wherein, wave action causing
(i) the first frame to move relative to the first floating hull
about its first set of axes of rotation
while simultaneously
moving relative to the second floating hull
about its second set of axes of rotation, and
while simultaneously the wave action causing
(ii) the second frame to move relative to the first floating hull
about its third set of axes of rotation while simultaneously
moving relative to the second floating hull
about its fourth set of axes of rotation.

23. The method of claim 22,
wherein in step (b)
the rotational axes of the second set of rotational axes, and
the rotational axes of the third set of rotational axes
are not parallel to each other.

24. The method of claim 22,
wherein in step (b)
the rotational axes of the second set of rotational axes
form a first universal joint, and
the rotational axes of the third set of rotational axes
form a second universal joint
wherein
(i) the first universal joint includes
a first shaft forming one of the two non-parallel axes
of rotation
of the first frame relative to the second catamaran hull, and
a second shaft forming the other of the two non-parallel axes of rotation
of the first frame relative to the second catamaran hull,
wherein
the first shaft of the first universal joint includes
a bore and
the second shaft of the first universal joint
is pivotally connected to the first shaft of the first universal joint
via the bore; and
(ii) the second universal joint includes
a first shaft forming one of the two non-parallel axes
of rotation
of the second frame relative to the first catamaran hull, and
a second shaft forming the other of the two non-parallel axes of rotation
of the second frame relative to the first catamaran hull,
wherein
the first shaft of the first universal joint includes
a bore and
the second shaft of the first universal joint
is pivotally connected to the first shaft of the first universal joint
via the bore.

* * * * *